US011739400B2

(12) United States Patent
Bian et al.

(10) Patent No.: US 11,739,400 B2
(45) Date of Patent: Aug. 29, 2023

(54) MAGNESIUM ALLOY AND METHOD FOR MANUFACTURING THE SAME

(71) Applicant: NATIONAL INSTITUTE FOR MATERIALS SCIENCE, Tsukuba (JP)

(72) Inventors: Ming-Zhe Bian, Tsukuba (JP); Taisuke Sasaki, Tsukuba (JP); Kazuhiro Hono, Tsukuba (JP); Shigeharu Kamado, Nagaoka (JP); Taiki Nakata, Nagaoka (JP)

(73) Assignee: NATIONAL INSTITUTE FOR MATERIALS SCIENCE, Tsukuba (JP)

( * ) Notice: Subject to any disclaimer, the term of this patent is extended or adjusted under 35 U.S.C. 154(b) by 0 days.

(21) Appl. No.: 16/971,406

(22) PCT Filed: Aug. 20, 2018

(86) PCT No.: PCT/JP2018/030611
§ 371 (c)(1),
(2) Date: Aug. 20, 2020

(87) PCT Pub. No.: WO2019/163161
PCT Pub. Date: Aug. 29, 2019

(65) Prior Publication Data

US 2021/0025035 A1 Jan. 28, 2021

(30) Foreign Application Priority Data

Feb. 21, 2018 (JP) ..... 2018-029237

(51) Int. Cl.
*C22C 23/04* (2006.01)
*C22C 1/02* (2006.01)
*C22F 1/06* (2006.01)

(52) U.S. Cl.
CPC ..... *C22C 23/04* (2013.01); *C22C 1/02* (2013.01); *C22F 1/06* (2013.01)

(58) Field of Classification Search
None
See application file for complete search history.

(56) References Cited

U.S. PATENT DOCUMENTS

2009/0291015 A1* 11/2009 Uggowitzer ..... C22C 23/04 420/404
2013/0144290 A1* 6/2013 Schiffl ..... C22F 1/06 606/62

(Continued)

FOREIGN PATENT DOCUMENTS

JP 2002-266044 A 9/2002
JP 2004-10959 A 1/2004

(Continued)

OTHER PUBLICATIONS

International Search Report dated Oct. 16, 2018, issued in counterpart International Application No. PCT/JP2018/030611. (2 pages).

(Continued)

*Primary Examiner* — Brian D Walck
(74) *Attorney, Agent, or Firm* — WHDA, LLP

(57) ABSTRACT

A magnesium alloy of the present invention has a structure, comprising: 0.5-2.0 wt % of Zn; 0.3-0.8 wt % of Ca; at least 0.2 wt % of Zr; and the remainder comprising Mg and unavoidable impurities, wherein a nanometer-sized precipitate comprising Mg, Ca and Zn dispersed on the (0001)

(Continued)

plane of a magnesium matrix, thereby achieving both formability and strength in a range of temperatures including room temperature.

10 Claims, 54 Drawing Sheets

(56) References Cited

U.S. PATENT DOCUMENTS

| | | | | |
|---|---|---|---|---|
| 2013/0209195 | A1 | 8/2013 | Kuwabara et al. | |
| 2016/0024629 | A1* | 1/2016 | Liang | C22C 23/00 148/557 |
| 2018/0087133 | A1 | 3/2018 | Nie et al. | |

FOREIGN PATENT DOCUMENTS

| | | | | |
|---|---|---|---|---|
| JP | 2006-28548 | A | 2/2006 | |
| JP | 2010-13725 | A | 1/2010 | |
| JP | 2013-79436 | A | 5/2013 | |
| JP | 2016-169427 | A | 9/2016 | |
| WO | 2012/049990 | A1 | 4/2012 | |
| WO | 2014/180187 | A1 | 11/2014 | |
| WO | 2016/161565 | A1 | 10/2016 | |
| WO | WO-2016161565 | A1 * | 10/2016 | C22C 23/00 |
| WO | WO-2016161566 | A1 * | 10/2016 | C22C 23/00 |

OTHER PUBLICATIONS

Kim et al., "Formation of a nanocomposite-like microstructure in Mg—6A1—1Zn alloy", Scripta Materialia 66, (2012), pp. 590-593. Cited in Specification. (4 pages).

Yamamura et al., "Collected Abstract of 2017, Autumn Meeting of The Japan Institute of Metals and Materials", The Japan Institute of Metalsand Materials, 2017. (11 pages).

Suh et al., "Development of heat treatable Mg—Zn alloy with excellent room temperature formability and high strength", National Institute for Materials Science (NIMS). (7 pages).

Suh et al., "Alloy design for the Development of Heat Treatable High Strength Mg Sheet Alloy with Excellent Room Temperature Formability", The Minerals, Metals & Materials Society 2018. (9 pages).

Bian et al., "Development of Heat-Treatable High-Strength Mg—Zn—Ca—Zr Sheet Alloy with Excellent Room Temperature Formability", The Minerals, Metals & Materials Society 2018. (11 pages).

Sasaki et al., "Development of heat-treatable Mg—Zn—Ca sheet alloy with high strength and excellent room temperature formability", National Institute for Materials Science (NIMS). (13 pages).

* cited by examiner 3 x 3 x 10 (nm)

MAGNESIUM ALLOY AND METHOD FOR MANUFACTURING THE SAME

TECHNICAL FIELD

The present invention relates to a magnesium alloy and a method for manufacturing the same.

BACKGROUND ART

Magnesium alloys are known as the lightest of all practical metals, and as a light-weight material alternative to an aluminum alloys, their application to railroad vehicles, airplanes and automobiles etc. is being considered. However, a wrought magnesium alloy is inferior to the aluminum alloy in strength and formability. To solve this problem and expand the application of the magnesium alloy, various studies have been conducted including the development of new wrought materials.

The wrought magnesium alloys manufactured by conventional technologies acquire the strength higher than 300 MPa through grain refinement by severe plastic deformation and addition of a rare earth metal element and zinc (Zn) as alloy elements (refer to Patent Literature 1). The alloys developed by the conventional technologies have practically many problems.

As shown in Patent Literature 1, the alloy with the rare earth metal added as the alloying element has an excellent strength. However, the use of the expensive rare earth metal in the alloy leads to an increase in material cost. Moreover, the primary processing for example hot working, and the secondary processing to form into the final shape cannot be easily carried out on the alloy, imposing high manufacturing cost. Thus, a possibility that sufficiently versatile materials to apply to automobiles, railroad vehicles and the like may be developed is substantially low.

A wrought material whose strength has been enhanced through grain refinement by severe plastic deformation, is known (refer to, for instance, Non Patent Literature 1). However, it is extremely difficult to carry out the secondary processing at room temperature on the wrought material, in which a deformed structure has been formed into the work-hardened state. Besides, it is also difficult to make large-sized members from the wrought material.

On the other hand, in addition to the development of high-strength alloys, a plenty of studies on the improvement of room temperature formability have been conducted (refer to Patent Literatures 2 and 3). In the examples reported by these studies, room temperature formability is evaluated using the Index Erichsen value (I.E. value).

Some reports disclose the examples of the development of the alloys, which have acquired the excellent room temperature formability comparable to those of aluminum alloys by adding alloy elements and/or improving the rolling process (refer to Patent Literature 3). However, the improvement of room temperature formability of these alloys is prone to the deterioration in strength. It should be noted that some studies have reported the examples of alloys, whose strength were improved by applying aging processing to certain kinds of casting materials and extruded materials (refer to Patent Literatures 4, 5).

CITATION LIST

Patent Literature

Patent Literature 1: JP 2013-79436 A
Patent Literature 2: JP 2004-10959 A

Patent Literature 3: JP 2010-13725 A
Patent Literature 4: JP 2002-266044 A
Patent Literature 5: JP 2016-169427 A

Non-Patent Literature

W. J. Kim, I. B. Park, S. H. Han, Scripta Materialia, 66 (2012) 590-593

SUMMARY OF INVENTION

Technical Problem

Meanwhile, to manufacture body panels for automobiles, alloys with 160 MPa in 0.2% proof strength and about 8 mm in Index Erichsen value, both of which are essential mechanical properties, are needed. In a plenty of applications, alloys, which are capable of exhibiting the intended strength and excellent room temperature formability, are strongly expected. However, the magnesium alloys and the manufacturing methods thereof by the conventional techniques do not allow highly versatile materials with intended strength and room temperature formability to be developed.

In view of such situation, the object of the present invention is to provide a highly versatile magnesium alloy capable of satisfying both requirements for formability at any in a range of temperatures including room temperature and for intended strength, and a method for manufacturing the magnesium alloy.

Solution to Problem

To achieve the aforementioned object, an magnesium alloy of the present invention according to a first embodiment has a structure, comprising: 0.5 wt. % or more to 2.0 wt % or less of Zn; 0.3 wt % or more to 0.8 wt % or less of Ca; and at least 0.2 wt % of Zr, a remainder comprising Mg and unavoidable impurities, and nanometer-order precipitates formed by Mg, Ca and Zn dispersed on the (0001) plane of magnesium matrix.

The magnesium alloy of the present invention according to a second embodiment has a structure, which additionally contains 0.1 wt % or more to 2.0 wt % or less Gd in the alloy composition in the first embodiment.

The magnesium alloy of the present invention according to a third embodiment has a structure, in which average size of grains in the magnesium matrix is 5 μm or more to 20 μm or less in the first embodiment.

The magnesium alloy of the present invention according to a fourth embodiment has a structure, in which a normalized basal texture intensity of (0002) face in the central part of plate thickness on a RD (the rolling direction)—TD (the transverse direction) face measured by the X-ray diffraction in the (0002) pole figure is less than 4.0 mrd in the first embodiment.

The magnesium alloy of the present invention according to a fifth embodiment has a structure whose Index Erichsen value at room temperature is 7.0 mm or higher in the first embodiment.

The magnesium alloy of the present invention according to a sixth embodiment has a structure, in which the 0.2% proof strength of the solution treated sample is 120 MPa or higher in the first embodiment.

The magnesium alloy of the present invention according to a seventh embodiment has a structure, in which the 0.2% proof strength of an aging treated material is 180 MPa or higher in the first embodiment.

A method for manufacturing the magnesium alloy of the present invention according to a first embodiment comprising:

process 1 of melting Mg, Zn, Ca and Zr to obtain a cast ingot;

process 2 of carrying out a homogenization treatment on the cast ingot to obtain a homogenized ingot;

process 3 of carrying out hot working or warm working on the homogenized ingot to obtain a material;

process 4 of carrying out a solution treatment on the material to obtain a solution treated sample; and process 5 of carrying out an aging treatment on the solution treated sample to obtain the magnesium alloy.

The method for manufacturing the magnesium alloy of the present invention, in which the homogenized ingot is reheated at 450° C. in process 3.

The method for manufacturing the magnesium alloy of the present invention, in which the homogenization treatment is carried out at a temperature between 400° C. or higher to 500° C. or lower for a given time period in process 2 and the aging treatment is carried out at a temperature between 140° C. or higher to 250° C. or lower for a given time period in process 5.

The method for manufacturing the magnesium alloy of the present invention, in which the aging treatment is carried out in process 5 until the hardness of the magnesium alloy increases.

Advantageous Effects of Invention

The present invention can provide the highly versatile magnesium alloy satisfying both the requirements for formidability in a range of temperatures including room temperature and the intended strength, and the method for the magnesium alloy.

DESCRIPTION OF EMBODIMENTS

Figure 1A:
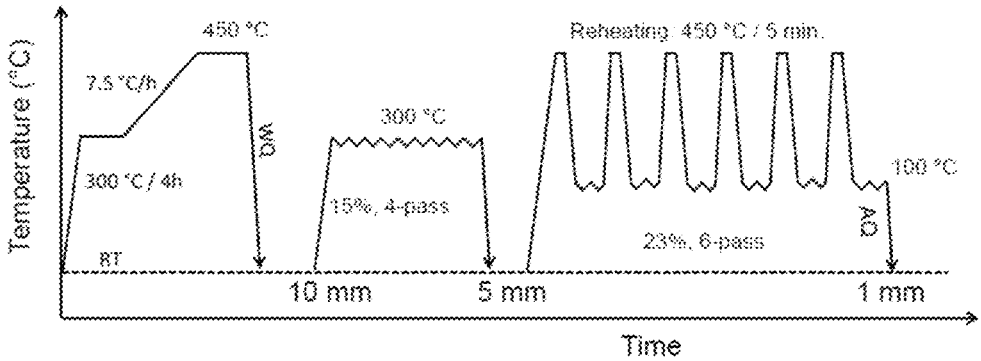
FIGS. 1(*a*) and 1(*b*) are schematics of processes 1 and 2, respectively of the manufacturing process of the magnesium alloys in the Examples of the present invention and Comparative Examples, wherein FIG. 1(*a*) illustrates the manufacturing processes of the magnesium alloy in Examples 1, 4 and 5 and Comparative Examples 1, 2 and 4, and FIG. 1(*b*) illustrates the processes in the Examples 2, 3, 6 and 7 and the Comparative Examples 3 and 5.

The embodiments of the present invention are described in detail hereinafter.

A magnesium (Mg) alloy of the present invention has a structure, which contains 0.5 wt % or more to 2.0 wt % or less of Zn (zinc), 0.3 wt % or more to 0.8 wt % or less of Ca (calcium) and at least 0.2 wt % of Zr (zirconium) with a remainder comprising Mg and unavoidable impurities.

Specifically, 0.1 wt % or more to 2.0 wt % or less of Gd (gadolinium) may be further added in the magnesium alloy of the present invention to decrease the degree of orientation of grains at the bottom, achieving more excellent room temperature formability. A suitable amount of Gd added to achieve the excellent room temperature formability is 0.3 wt %. 0.1 wt % or lower concentration of Gd is not preferable because it is not effective in decreasing the degree of orientation of grains at the bottom. 2.0 wt % or higher concentration of Gd is not preferable because not only formability is greatly deteriorated due to the formation of second phase particles but also a higher material cost is imposed.

The above magnesium alloy has a magnesium matrix comprising Mg solid solution including Mg, Zn, Ca and Zr, and precipitates containing one or more of Zn, Ca and Zr elements. The magnesium alloy is not limited to a particular form; for instance, it may take the forms of various materials such as plate materials, as well as the forms of intermediates and final products.

Preferably, the average size of grains in the magnesium matrix of the magnesium alloy of the present invention is 5 μm to 20 μm after the solution treatment. Too large grain sizes are not preferable because a deformed twin, from which a crack may occur, is easily formed, leading to greatly deteriorated room temperature formability.

The precipitates of the aging-treated magnesium alloy of the present invention include the one comprising Mg, Ca and Zn. The precipitates of Mg, Ca and Zn are nanometer-sized precipitates dispersed on the (0001) plane of the magnesium matrix called a G. P. Zone (Guinier Preston Zone). The formation of the precipitates of Mg, Ca and Zn during the aging treatment may improve the strength of the alloy. It is only required that the precipitates are dispersed so that a plenty of nanometer-order fine precipitates are deposited. The precipitates comprising Mg, Ca and Zn (G. P. Zone) observed in the aging treated material of the magnesium alloy may be plate-like precipitates and not limited to particular forms.

The Zn content in the magnesium alloy of the present invention falls preferably 0.5 wt % or more to 2.0 wt % or less. It contains more preferably 0.8 wt % or more Zn to achieve the formation of a high-density G. P. Zone during the aging treatment. Lower wt % of Zn is not preferable because it increases the degree of orientation of grains, leading to failure to achieve the excellent room temperature formability. On the other hand, higher wt % of Zn is not preferable because it causes not only the melting point of the alloy to lower, leading to possible crack occurrence during the cooling treatment following the solution treatment, but also the age hardening ability of the alloy to substantially deteriorate.

The Ca content in the magnesium alloy of the present invention contains preferably 0.3 wt % or more to 0.8 wt % or less because the addition of Ca reduces the basal texture intensity on the (0002) face, resulting in the formation of the high-density G. P. Zone during the aging treatment. The addition of lower wt % of Ca is not preferable because precipitation of the most effective strengthening phase is not expected as described later. On the other hand, the addition of higher wt % of Ca is not preferable because the precipitates comprising Mg and Ca are formed, leading to deteriorated formidability and ductility.

The Zr content in the magnesium alloy of the present invention contains preferably at least 0.2 wt %. The magnesium alloy of the present invention contains desirably 0.2 wt % of Zr or more. The Zr content is still preferably 1.0 wt % or less.

The number density of the precipitates (G. P. Zone) is preferably high. Too lower number density of the precipitates is not preferable because it does not lead to the strengthening by the precipitates. The suitable number density of the G. P. Zone is $4.5\times10^{22}$ $m^{-3}$ to $5\times10^{23}$ $m^{-3}$. With this number density, the strength of the alloy is expected to be improved by about 30 MPa to 90 MPa by the T6 treatment.

The normalized basal texture intensity on the (0002) pole in the central part of the plate thickness on the RD-TD face measured by the X-ray diffraction in the (0002) pole figure is less than 4.0 mrd. This allows the degree of orientation of grains to be decreased, achieving excellent formability.

The magnesium alloy of the present invention may have 7.0 mm or higher of the Index Erichsen value at room temperature and preferably 7.5 mm. This allows the formidability of the magnesium alloy by the treatments such as press working at room temperature to be improved, especially during hot working. The above Index Erichsen value (I.E. value) is used to evaluate the room temperature formidability of alloys using the Erichsen cupping test by following the steps of: pressing a thin metal sheet by a hemispheric punch with its circumferential edge fixed between jigs at a given punch speed, causing a dome to be formed on the thin metal sheet; and measuring the height of the dome continuously up to break occurrence.

It is preferable that the magnesium alloy of the present invention satisfies the requirements for not only improvement of room temperature formability but also 146 MPa or higher of 0.2% proof strength achieved after the solution treatment. The magnesium alloy of the present invention has preferably 20% or higher elongation to failure. An increase in the Vickers hardness is preferably at least 8 HV or higher. The 0.2% proof strength of the aging treated material of the magnesium alloy of the present invention may be 180 MPa or higher and is preferably 200 MPa. The 0.2% proof strength is also referred to as the yield strength.

Hereinafter, a method for manufacturing the magnesium alloy of the present invention is described.

The method for manufacturing the Magnesium alloy of the present invention comprises: process 1 of melting and casting Mg, Zn, Ca and Zr to obtain a cast ingot; process 2 of carrying out the homogenization treatment on the cast ingot to obtain a homogenized ingot; process 3 of carrying out hot working or warm working on the homogenized ingot to obtain a material; process 4 of carrying out the solution treatment on the material to obtain solution treated sample; and process 5 of carrying out the aging treatment on the solution treated sample to obtain the magnesium alloy.

(Process 1: Casting)

In process 1, the alloy composition including 0.5 to 2.0 wt % of Zn, 0.3 to 0.8 wt % of Ca and at least 0.2 wt % of Zr with the remainder comprising Mg and unavoidable impurities, are melt to manufacture a cast ingot. The type of a melting furnace used in a melting process and the size of the cast ingot are not particularly limited and are only required to allow the cast ingot of desired composition to be manufactured.

(Process 2: Homogenization Treatment)

In process 2, the homogenization treatment is carried out on the cast ingot at a temperature in a range of 300 or higher to 500° C. or lower for a given time period to manufacture a homogenized ingot. In the homogenization treatment, the distributions of the alloying elements in the cast ingot are homogenized to dissolve the precipitates formed during cooling of molten metal in the magnesium matrix. In a region, where Zn is macro-segregated at a high concentration, the alloy may be melted if the hot working is started at 450° C. To address this problem, the hot working is started at 300° C. to suppress initial melting of an Mg—Zn phase formed during the casting process for dispersing Zn, and then carried out at a temperature in a range of 400 or higher to 500° C. or lower for the given time period for homogenizing a Zn distribution to obtain the homogenized ingot.

The conditions for the homogenization treatment are not limited particularly, and only required to be set depending on the cast ingot or the alloy element components. It is only required to allow the alloy elements to form solid solution in the magnesium matrix by thermal treatment at the given temperature for the given time period.

(Process 3: Hot or Warm Working)

In process 3, the homogenized ingot is processed into a sheet material by warm rolling to manufacture a sheet-shaped material. In the rolling process, the homogenized material is processed into a sheet-shaped material under the given rolling conditions such as the sample temperature, rolling temperature, roll speed, roll circumferential speed, number of passes, existence of intermediate heat treatment of the sample, and temperature and duration of intermediate heat treatment.

Table 1 lists the rolling conditions for the magnesium alloys in the Examples of the present invention and the Comparative Examples described later as the example of process 3. Symbols A to F are added to differentiate between the chemical compositions of the individual magnesium alloys and pre-rolling homogenization treatment conditions. As shown in Table 1, the individual magnesium alloys have the compositions described below.

A:
Chemical composition: Mg-0.8Zn-0.5Ca-0.4Zr
Homogenization conditions: The temperature is kept at 300° C. for 4 hours, increased to 450° C. at the rate of 7.5° C./h, kept at 450° C. for 6 hours, and then the sample is water quenched.

B:
Chemical composition: Mg-1.6Zn-0.5Ca-0.4Zr
Homogenization conditions: The temperature is kept at 300° C. for 4 hours, raised to 450° C. at the rate of 7.5° C./h, kept at 450° C. for 6 hours, and then the sample is air cooled down to 300° C. and is water quenched.

C:
Chemical composition: Mg-1.6Zn-0.5Ca-0.4Zr-0.3Gd
Homogenization conditions: The temperature is kept at 300° C. for 4 hours, raised to 450° C. at the rate of 7.5° C./h, kept at 450° C. for 6 hours, and then the sample is air cooled down to 300° C. and is water quenched.

D:
Chemical composition: Mg-0.8Zn-0.8Ca-0.4Zr
Homogenization conditions: The temperature is kept at 300° C. for 4 hours, raised to 450° C. at the rate of 7.5° C./h, kept at 450° C. for 6 hours, and then the sample is water quenched.

E:
Chemical composition: Mg-0.8Zn-0.8Ca-0.2Zr
Homogenization conditions: The temperature is kept at 300° C. for 4 hours, raised to 450° C. at the rate of 7.5° C./h, kept at 450° C. for 6 hours, and then the sample is water quenched.

F:
Chemical composition: Mg⁻1.6Zn-0.4Zr
Homogenization conditions: The temperature is kept at 300° C. for 4 hours, raised to 450° C. at the rate of 7.5° C./h, kept at 450° C. for 6 hours, and then the sample is air cooled down to 300° C. and is water quenched.

TABLE 1

| | | Rolling conditions | | | | | | | | |
|---|---|---|---|---|---|---|---|---|---|---|
| | | Rough rolling process (Plate thickness 10→ 5 mm, Circumferential rolling speed: 2 m/min) | | | | Final rolling process (Plate thickness: 5→1 mm), Circumferential rolling speed: 2 m/min. | | | | |
| Symbol | Chemical composition (wt. %) | Sample temperature ° C. | Rolling temperature ° C. | Rolling rate % | Number of passes Times | Sample temperature ° C. | Rolling temperature ° C. | Sample reheating temp. ° C. | Rolling rate % | Number of passes Times |
| A | Mg—0.8Zn—0.5Ca—0.4Zr | 300 | 300 | 15 | 4 | 100 | 100 | 450 | 23 | 6 |
| B | Mg—1.6Zn—0.5Ca—0.4Zr | | | | | | | | | |
| C | Mg—1.6Zn—0.5Ca—0.4Zr—0.3Gd | | | | | | | | | |
| D | Mg—0.8Zn—0.8Ca—0.4Zr | | | | | | | | | |
| E | Mg—0.8Zn—0.8Ca—0.2Zr | | | | | | | | | |
| F | Mg—1.6Zn—0.4Zr | | | | | | | | | |

Table 1 shows the intermediate heat treatment in the sample reheating temperature columns under "Final rolling process". The upper limit and lower values of the intermediate heat treatment temperatures are preferably 500° C. and 300° C., respectively. The intermediate heat treatment at a temperature lower than 300° C. interferes with the recrystallization of the deformed structure, leading to deteriorated rollability. In addition, the G. P. Zone is formed, causing the sample temperature to rise during heat treatment, which in turn, leads to deteriorate the rollability. Moreover, a structure with the strongly oriented grains at the bottom, in which it is not expected to achieve the excellent room temperature formidability, is formed. The intermediate heat treatment at 500° C. or higher may cause the sample to oxidize or ignite. Moreover, there will be a possibility that a structure with the strongly oriented grains at the bottom, in which it is not expected to achieve the excellent room temperature formidability, is formed.

In the final rolling process, the sample is preferably reheated, if carried out, between all the rolling passes. During the sample reheating, the given temperature is preferably kept for 2 minutes to 60 minutes and more preferably 2 minutes to 10 minutes. Most preferably, the temperature is kept for about 5 minutes. The sample reheating for less than 2 minutes is not preferable because it interferes with the recrystallization of the structure, causing its rollability to deteriorate. The sample reheating for 10 minutes is sufficient to cause recrystallization. In contrast, the sample reheating for longer than 10 minutes is not preferable because the sample oxidizes or the structure is toughed, leading to not only deteriorated rollability but also greatly reduced productivity. After the sample reheating, the sample is air cooled down to the given sample temperature and then the rolling treatment is carried out on the sample.

The sample temperature and the rolling temperature may be set to low levels at which the sample would not crack during the rolling process. The rolling rate may be set to a high level at which the sample would not crack during the rolling process. The intermediate heat treatment of the sample, which is performed during the rolling process, may be carried out at any of high temperatures where no crack would occur during the cooling process and the sample would not locally melt. The hot or warm working is not limited particularly to the rolling process and may be any of swaging processing methods allowing a microstructure to be manufactured, for instance, any of the methods including twin roll casting rolling, forging and extrusion processing.

(Process 4): Solution Treatment)

In process 4, a solution treatment is carried out on the plate-like material and cooled down to manufacture the solution treated sample. In the solution treatment, by subjecting the material to heat treatment, fine precipitates formed during the hot or warm working are made to be dissolved into the matrix and then re-crystalized to form a composition.

The solution treatment carried out after the hot or warm working allows the grains to be randomly oriented, achieving excellent formability. The solution treatment is carried out by keeping the solution treatment temperature in a range of 350° C. to 500° C. for 15 minutes to 24 hours depending on the material. It should be noted that the time of heat treatment should not be carried out for a time period longer than is needed; otherwise, the manufacturing costs may increase.

(Process 5: Aging Treatment)

In process 5, the solution treated sample is age hardened by the heat treatment to disperse the precipitates on it, resulting in the enhanced strength in order to manufacture the magnesium alloy of the present invention. Here, carrying out the aging treatment, which has not been used in commercial magnesium alloys, allows the significantly toughened magnesium alloys to be achieved. The aging treatment is carried out at a temperature in a range of 140° C. to 250° C. for the given time period. The aging treatment is carried out for the time period preferably until the hardness of the magnesium alloy increases and more preferably until the hardness of magnesium alloy increases up to the maximum level.

The time period for the aging treatment is preferably any in a range of 5 minutes to 24 hours. Short age hardening time period is not preferable because the sufficient density number of precipitates are not formed, leading to failure to expect the enhanced strength. In contrast, long age hardening time period is not preferable because the precipitate phase changes from the G. P. Zone to its stable phase, leading to failure to expect the greatly enhanced strength.

The magnesium alloy of the present invention manufactured in this way is the alloy, which has the structure comprising: 0.5 wt % to 2.0 wt % of Zn; 0.3 wt % to 0.8 wt % of Ca and at least 0.2 wt % of Zr with the remainder comprising Mg and unavoidable impurities, and the nanometer-order precipitates comprising Mg, Ca and Zn dispersed on the (0001) plane of the magnesium matrix.

According to the aforementioned magnesium alloy and the method for manufacturing thereof, the solution treatment carried out after the rolling process allows the grains to be randomly oriented, achieving excellent formability. However, randomly orienting the grains rapidly deteriorates the strength; forming nano-size precipitates can satisfy the requirements for formability, strength and ductility.

In addition, according to the magnesium alloy and the manufacturing method thereof, the highly versatile magnesium alloy capable of satisfying both requirements for the formability in the given range of temperatures including room temperature and the strength may be obtained. For instance, the proof strength and room temperature formability, which are required for mechanical properties allowing automotive materials to be used for automobile body panels and the like, may be achieved. The heat treatment or processing technique combining simple rolling and heat treatment steps using existing equipment provides alloys made of low cost alloying elements with no need for expensive and scarce rare earth metal elements, which achieve formability and room temperature strength far superior to the sheet materials of the conventional commercial magnesium alloys. Thus, the properties required for the materials such as automotive materials may be satisfied.

The aforementioned embodiment may be modified within the scope of the present invention as needed. The manufacturing method for the aforementioned magnesium alloy has been described with the example, which comprises the steps of: carrying out the hot or warm working; applying various works such as drawing and bending to the solution treated magnesium alloy to manufacture the formed body; and carrying out the aging treatment to enhance the strength. Alternatively, the formed body may be manufactured by the steps of: carrying out the hot or warm working, the solution treatment and the aging treatment in order to manufacture the magnesium alloy; and applying various works such as drawing and bending to the alloy. However, the magnesium alloy may be manufactured by the hot or warm working and the solution treatment with no aging treatment; hence, the method of the present invention may be applied as the method for manufacturing processed materials.

EXAMPLES

Next, Examples of the present invention will be described. The individual components of the alloy composition are herein denoted by weight percentage (%). The numbers prefixed to the elements Zn, Ca, Zr and Gd excluding Mg indicate the wt % thereof. Hereinafter, the samples A to F enclosed in parentheses at the end of "Alloy composition" correspond to the chemical composition (wt %) in Table 1.

Example 1

Alloy composition: Mg-0.8Zn-0.5Ca-0.4Zr (Sample A)

Rough rolling process: Sample temperature 100° C., rolling temperature 100° C.

Reheating temperature: At 450° C. for 5 minutes

Solution treatment: At 400° C. for 1 hour

Aging treatment: At 170° C. for 4 hours (Process 1: Casting)

The alloy of Mg-0.8Zn-0.5Ca-0.4Zr was melted using a high frequency induction melting furnace (ULVAC, FMI-I-20F) and then was cast in a mold to manufacture a cast ingot. The thickness of the cast ingot was approximately 10 mm.

(Process 2: Homogenization Treatment)

Figure 1B:
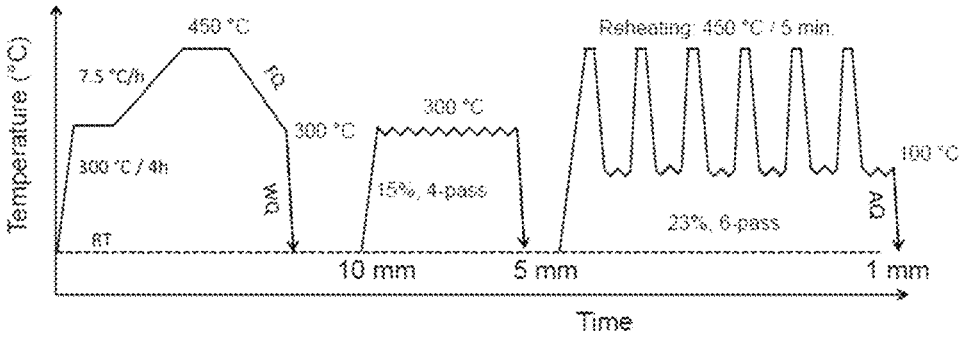

As shown in FIG. 1(*a*), the homogenized ingot was manufactured by following the procedure for the homogenization treatment comprising the steps: heating the cast ingot at 300° C. for 4 hours; raising the temperature up to 450° C. at a rate of 7.5° C./h; keeping the temperature at 450° C. for 6 hours; and water-hardening the ingot for cooling. In the homogenization treatment, the cast ingot was heated first at 300° C. and then was heated treated at 400° C. to 500° C. to suppress initial melting of the Mg—Zn phase formed during casting in order to homogenize the Zn distribution.

(Process 3: Hot or Warm Working)

A material was manufactured by passing the homogenized ingot through the rolling mill capable of applying pressure (UENOTEX, H9132) to carry out the rough rolling process and the final rolling process.

As shown in FIG. 1(*a*), in the rough rolling process, the homogenized ingot was passed through the rolling mill 4 times at the rolling rate of 15% with the sample and the roll temperature was set to 300° C. using the rolling equipment with circumferential rolling speed of 2 m/min to roll the 10 mm thickness homogenized ingot so as to thin down to 5 mm thickness.

The final rolling process following the rough rolling process was carried out while the intermediate heat treatment was applied, using the rolling equipment with circumferential rolling speed of 2 m/min. As shown in FIG. 1(*a*), in the final rolling process, the homogenized ingot was passed through the rolling passage 6 times with the 23% reduction per pass and the rolling temperature was set to 100° C. The material was manufactured by carrying out the final rolling process to thin down to 1 mm thickness, while the intermediate heat treatment was applied with the sample reheating temperature kept at 450° C. for 5 minutes, and the sample was air cooled every time the homogenized ingot was passed through the rolling passage. The static crystallization was achieved by the intermediate heat treatment to decrease the degree of orientation of grains.

(Process 4: Solution Treatment)

The solution treated sample was manufactured by carrying out the solution treatment on a plate-like material. The solution treatment was carried out by heating the material at 400° C. for 1 hour.

Figure 2:
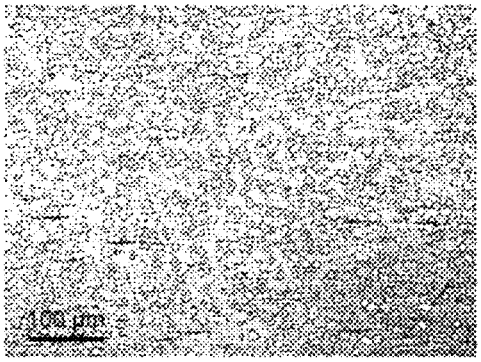
FIG. 2 shows an optical microscope image of the solution sample 1 in the Example 1.
Figure 3:
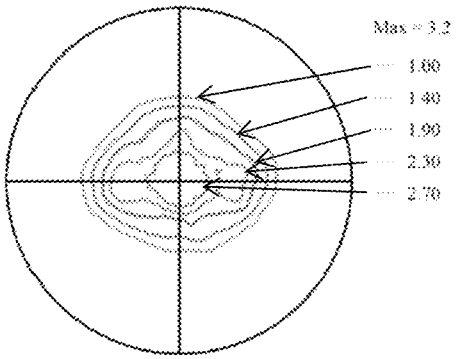
FIG. 3 shows the (0002) pole figure of the solution treated sample in the Example 1.

FIG. 2 shows the optical microscope image (NIKON, Eclipse LV-1000) of the solution treated sample. The grain size calculated by the linear interception method was 9.0 μm. The grain size was calculated in accordance with the lineal intercept method (E112-13) defined in the Standards by America Society for Testing and Materials (ASTM). FIG. 3 shows the (0002) pole figure of the solution treated sample obtained by the X-ray diffraction. The maximum random distribution (m.r.d) at the pole (0002) (also referred to as basal texture intensity) was 3.2. The basal texture intensity is the index that indicates the relative strength of the texture on the (0002) plane (random orientation regarded as 1).

(Process 5: Aging Treatment)

The aging treatment was carried out on the solution treated sample at 170° C. for 4 hours to obtain the magnesium alloy as the aging treated material.

Figure 4:
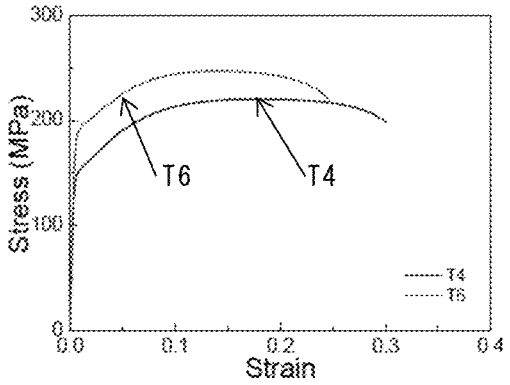
FIG. 4 shows the tensile curves of the solution treated sample and the aging treated material in the Example 1.
Figure 5:
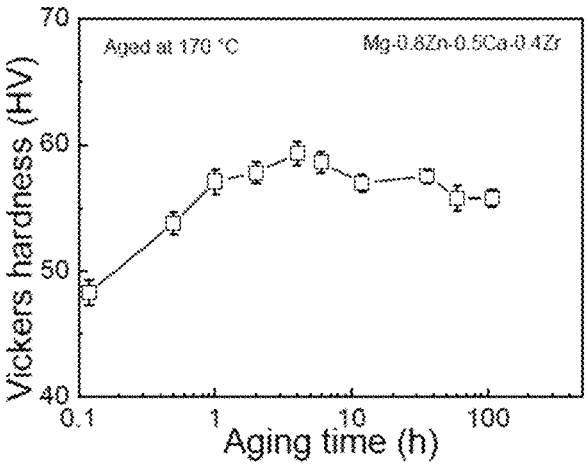
FIG. 5 shows an age hardening curve in the Example 1.

FIG. 4 shows the tensile curves of the solution treated sample (T4), obtained in process 4 and of the aging treated material (T6) obtained in process 5. FIG. 5 shows the age hardening curve of the aging treated material (T6).

As shown in Table 2, the result of the measurement of mechanical strength of the obtained solution treated sample by the Erichsen test (Testing machine: Erichsen, Type 111) shows that the Index Erichsen value was 7.7 mm, the yield strength (0.2% proof strength) was 146 MPa, the tensile strength was 220 MPa and the elongation to failure was 30%. The solution treated sample has the excellent room temperature formability. As shown in Table 2, the result of the measurements of the mechanical strength of the obtained magnesium alloy (T6) shows that the yield strength was 187 MPa, the tensile strength was 247 MPa and the elongation to failure was 25%. Thus, the yield strength of the magnesium alloy (T6) was significantly enhanced up to 187 MPa by virtue of the aging treatment.

TABLE 2

| | Yield strength $\delta_{YS}$ (MPa) | Tensile strength $\delta_{UTS}$ (MPa) | Elongation $\varepsilon_{total}$ (%) | Formability Index Erichsen |
|---|---|---|---|---|
| Solution treated sample (T4) | 146 | 220 | 30 | 7.7 |
| Aging-treated material (T6) | 187 | 247 | 25 | — |

As shown in Table 3, the result of the measurement of mechanical strength of the obtained magnesium alloy shows that the Vickers hardness was 59.3 HV, the time required to reach the peak hardness was 4 hours and the increase in hardness by the aging treatment was 11 HV.

TABLE 3

| Peak hardness (HV) | Time required to reach the peak hardness (h) | Increase in hardness (HV) |
|---|---|---|
| 59.3 | 4 | 11 |

It should be noted that the parameters for mechanical strength measured in Example 1, including the optical microscope image, the grain size, the basal texture intensity, the tensile curve, the age hardening curve, the Index Erichsen value, the yield strength, the tensile strength and the elongation the elongation to failure were also measured in Examples 2 to 8 and Comparative examples 1 to 6 described later.

Example 2

Alloy composition: Mg-1.6Zn-0.5Ca-0.4Zr (Sample B)

Rough rolling process: Sample temperature 100° C., rolling temperature 100° C.

Reheating temperature: At 450° C. for 5 minutes

Solution treatment: At 400° C. for 1 hour

Aging treatment: At 170° C. for 2 hours (Process 1: Casting)

In the same manner as Example 1, the alloy of Mg-1.6Zn-0.5Ca-0.4Zr was melted using the high frequency induction melting furnace and then was cast in the mold to manufacture a cast ingot. The thickness of the cast ingot was approximately 10 mm.

(Process 2: Homogenization Treatment)

As shown in FIG. 1(*b*), the cast ingot was heated at 300° C. for 4 hours, the temperature was raised to 450° C. at a rate of 7.5° C./h, and kept the temperature at 450° C. for 6 hours for heat treatment. Next, the cast ingot was removed from the heating furnace, air-cooled down to 300° C., and water-quenched for homogenization treatment to manufacture the homogenized ingot. In the homogenization treatment, to suppress initial melting of the Mg—Zn phase formed during casting, the cast ingot was heat treated at 300° C. and then was heated treated at 400° C. to 500° C. to homogenize the Zn distribution.

(Process 3: Hot or Warm Working)

In the same manner as Example 1, the material was manufactured by passing the homogenized ingot through the rolling passage capable of applying pressure by a rolling equipment (UENOTEX, H9132) to carry out individually the rough rolling process and the final rolling process.

As shown in FIG. 1(*b*), in the rough rolling process, the homogenized ingot was passed through the rolling passage 4 times at the rolling rate of 15% with the sample and rolling temperatures set to 300° C. using the rolling equipment with circumferential rolling speed of 2 m/min to roll the 10 mm thickness homogenized ingot so as to thin down to 5 mm thickness.

The final rolling process following the rough rolling process was carried out while the intermediate heat treatment was applied, using the rolling equipment with circumferential rolling speed of 2 m/min. As shown in FIG. 1(*b*), in the final rolling process, the homogenized ingot was passed through the rolling passage 6 times at the rolling rate of 23% with the sample and rolling temperatures set to 100° C. The material was manufactured by carrying out the final rolling process to thin down to 1 mm thickness, while the intermediate heat treatment was applied with the sample reheating temperature kept at 450° C. for 5 minutes and the sample was air cooled every time the homogenized ingot was passed through the rolling passage. The static crystallization was achieved by the intermediate heat treatment to decrease the degree of orientation of grains.

(Process 4: Solution Treatment)

The solution treated sample was manufactured by carrying out the solution treatment on a plate-like material. The solution treatment was carried out by heating the material at 400° C. for 1 hour.

Figure 6:
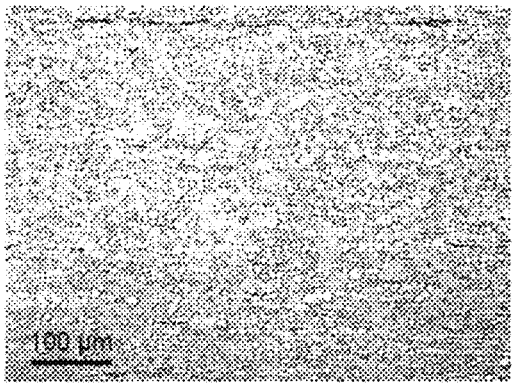
FIG. 6 shows the optical microscope image of the solution treated sample in the Example 2.
Figure 7:
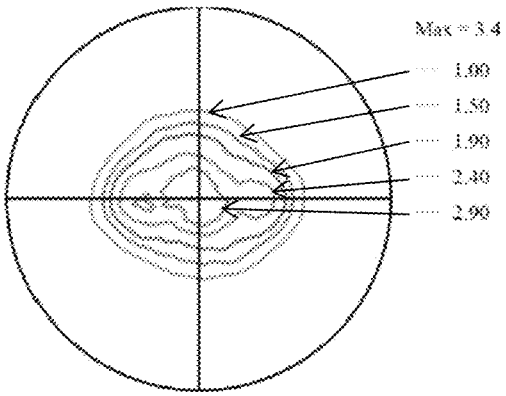
FIG. 7 shows the (0002) pole figure of the solution treated sample in the Example 2.

FIG. 6 shows the optical microscope image of the solution treated sample. The same optical microscope was used as Example 1. The grain size calculated by the linear interception method was 9.0 μm. The grain size was calculated in accordance with the ASTM (E112-13) in the same manner as Example 1. FIG. 7 shows the (0002) pole figure of the solution treated sample obtained by the X-ray diffraction. The basal texture intensity at the (0002) pole was 3.4 mrd.

(Process 5: Aging Treatment)

The aging treatment was carried out on the solution treated sample at the aging temperature of 170° C. for 2 hours to obtain the magnesium alloy as the aging treated material.

Figure 8:
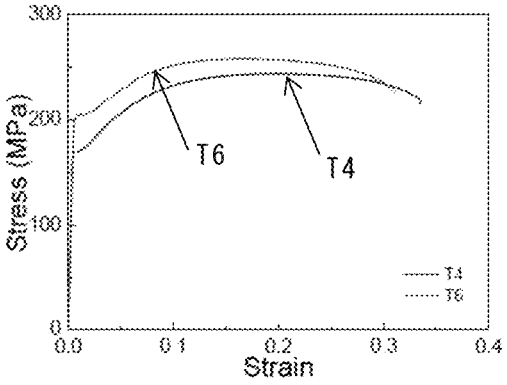
FIG. 8 shows the tensile curves of the solution treated sample and the aging treated material in the Example 2.
Figure 9:
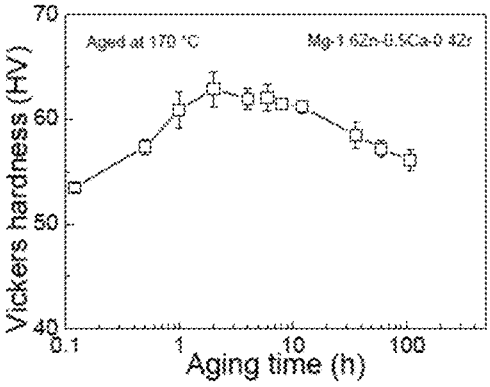
FIG. 9 shows the age hardening curve in the Example 2.

FIG. 8 shows the tensile curves of the solution treated sample (T4), obtained in process 4 and of the aging treated material (T6) obtained in process 5. FIG. 9 shows the age hardening curve of the aging treated material (T6).

As shown in Table 4, the result of the measurement of mechanical strength obtained by the solution treated sample shows that the Index Erichsen value was is 8.2 mm, the yield strength was 163 MPa, the tensile strength was 245 MPa and the elongation to failure 34%. The solution treated sample has the excellent room temperature formability. As shown in Table 4, the result of the measurement of mechanical strength of the obtained magnesium alloy show that the yield strength was 204 MPa, the tensile strength was 258 MPa and the elongation to failure was 31%. Thus, the yield strength of the magnesium alloy was significantly enhanced up to 204 MPa by virtue of the aging treatment.

TABLE 4

| | Yield strength $\delta_{YS}$ (MPa) | Tensile strength $\delta_{UTS}$ (MPa) | Elongation $\varepsilon_{total}$ (%) | Formability Index Erichsen |
|---|---|---|---|---|
| Solution treated sample (T4) | 163 | 245 | 34 | 8.2 |
| Aging-treated material (T6) | 204 | 258 | 31 | — |

As shown in Table 5, the result of the measurement of mechanical strength obtained by the magnesium alloy shows that the Vickers hardness was 62.9 HV, the time required to reach the peak hardness was 2 hours and the increase in hardness by the aging treatment was 9.4 HV.

TABLE 5

| | Yield strength $\delta_{YS}$ (MPa) | Tensile strength $\delta_{UTS}$ (MPa) | Elongation $\varepsilon_{total}$ (%) | Formability Index Erichsen (mm) |
|---|---|---|---|---|
| Solution treated sample (T4) | 163 | 245 | 34 | 8.2 |
| Aging-treated material (T6) | 204 | 258 | 31 | — |

Figure 10:
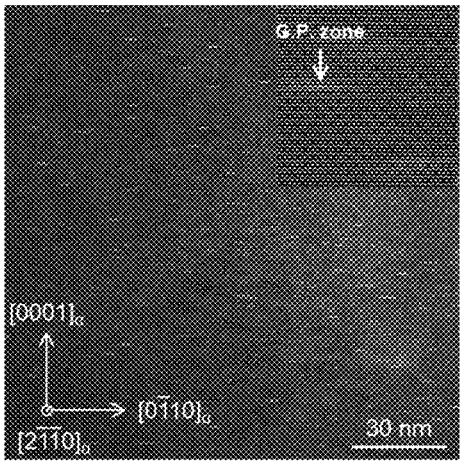
FIGS. 10(*a*), (*b*), (*c*) and (*d*) show views illustrating observational results of the aging treated material in the Example 2, wherein FIG. 10(*a*) shows a TEM bright field image, FIG. 10(*b*) shows a 3-dimensional atom map, FIG. 10(*c*) shows an enlarged view of the 3-dimensional atom map in (*b*) and FIG. 10(*d*) shows a longitudinal concentration profile of the enlarged view of the 3-dimensional atom map in FIG. 10(*c*), respectively.
Figure 10:
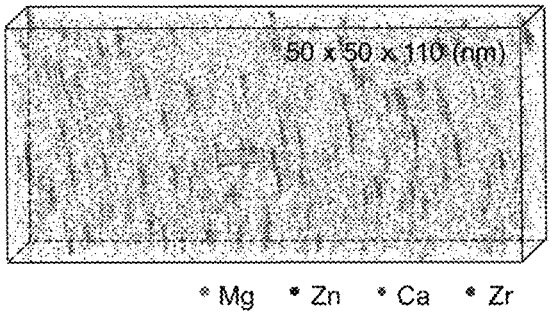
Figure 10:
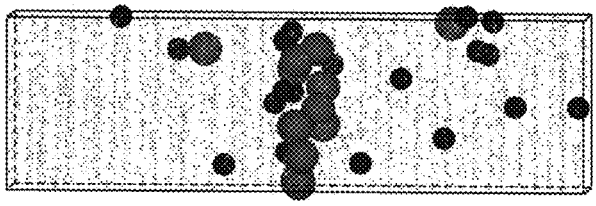
Figure 10:
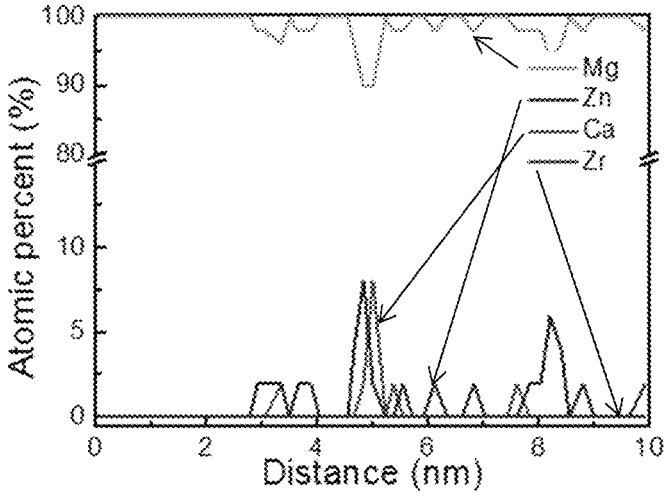

FIGS. 10(*a*), 10(*b*), 10(*c*) and 10(*d*) are observation charts of the aging treated material in Example 2, wherein FIG. 10(*a*) is a bright field transmission electron microscope, FIG. 10(*b*) is the three dimensional atom map, FIG. 10(*c*) is the enlarged view of a 3-dimensional atom map of FIG. 10(*b*), and FIG. 10(*d*) is the result of a longitudinal elemental analysis of FIG. 10(*c*). The scanning transmission electron microscope made by FEI (Titan, G2 80-200) was used as the transmission electron microscope. The image obtained from the transmission electron microscope is referred to as the TEM image. As indicated by an arrow head in the upper right part of the TEM bright field image viewed from the [0101], [01 (bar)10] in FIG. 10(*a*), the G. P. Zone, of which the longitudinal direction is [01 (bar)10], was identified. As shown in FIG. 10(*a*), the plate-like G. P. Zone is formed on the (0001) plane of magnesium matrix. The G. P. Zone has a size of 4 nm to 5 nm in diameter and one atomic layer in thickness.

The 3-dimensional atom probe (simply referred to as 3DAP) is a technique for measuring a 3-dimentional atomic distribution by following procedure, comprising the steps of: applying a high voltage onto the sample; detecting ions electric-field evaporated from the sample surface by a mass spectrometer; detecting continuously the individual detected ions in the depth direction; and aligning the ions detected in order. The 3DAP was self-built by Kazuhiro Hono, an inventor thereof, National Institute for Materials Science. The mass spectrometer (ADLD detector) made by CAMECA was used for ion analysis.

The measuring ranges of the 3-dimentional atom probes shown in FIGS. 10(*b*) and 10(*c*) are 50 nm×50 nm×110 nm and 3 nm×3 nm×10 nm, respectively. As shown in FIGS. 10(*b*) and 10(*c*), it was verified that the G. P. Zone observed in FIG. 10(*a*) comprising Zn, Ca and Zn. The number density of the G. P. Zone was $8.0\times10^{22}$ $m^{-3}$. The concentration profile shown in FIG. 10(*d*) was obtained from the 3-dimensional atom map shown in FIG. 10(*c*). As shown in FIG. 10(*d*), it was verified that the G. P. Zone shown in FIG. 10(*a*) comprising Mg, Ca and Zn.

Example 3

Alloy composition: Mg-1.6Zn-0.5Ca-0.4Zr-0.3Gd (Sample C)

Rough rolling process: Sample temperature 100° C., rolling temperature 100° C.

Reheating temperature: At 450° C. for 5 minutes

Solution treatment: At 400° C. for 1 hour

Aging treatment: At 170° C. for 4 hours

Adding Gd allows the degree of orientation at the bottom of the magnesium matrix to be further decreased, and more excellent room temperature formability is expected. To achieve further excellent room temperature formability, 0.1 wt % to 2.0 wt % of Gd may be added. Specifically, the suitable amount of Gd to be added is 0.3 wt % to decrease the degree of orientation of grains at the bottom, achieving the excellent room temperature formability. When the concentration of Gd is 0.1 wt % or less, it is not preferable because it is not effective in reducing the degree of orientation of the bottom surface of the magnesium matrix. The Gd concentration higher than 2.0 wt % is not preferable because of not only leading to a great deterioration in formability due to the formation of the secondary phase of particles such as $Mg_5Gd$ but also coming to a rise in material cost.

(Process 1: Casting)

In the same manner as Examples 1 etc., the alloy of Mg-1.6Zn-0.5Ca-0.4Zr-0.3Gd was melted using the high frequency induction melting furnace and then cast in the mold to manufacture a cast ingot. The thickness of the cast ingot was approximately 10 mm.

(Process 2: Homogenization Treatment)

As shown in FIG. 1(*b*), the cast ingot was heated at 300° C. for 4 hours, the temperature was raised to 450° C. at a rate of 7.5° C./h, and the temperature was kept at 450° C. for 6 hours for heat treatment. Next, the cast ingot was removed from the heat treatment furnace, air-cooled down to 300° C., and water-quenched for homogenization treatment to manufacture the homogenized ingot. In the homogenization treatment, to suppress initial melting of the Mg—Zn phase formed during casting, the cast ingot was heat treated at 300° C. and then was heated treated at 400° C. to 500° C. to homogenize the Zn distribution.

(Process 3: Hot or Warm Working)

In the same manner as Example 1 etc., the material was manufactured by passing the homogenized ingot through the rolling passage capable of applying pressure by the rolling equipment to carry out individually the rough rolling process and the final rolling process.

As shown in FIG. 1(*b*), in the rough rolling process, the homogenized ingot was passed through the rolling passage 4 times at the rolling rate of 15% with the sample and rolling temperatures set to 300° C. using the rolling equipment with the circumferential rolling speed of 2 m/min to roll the 10 mm thickness homogenized ingot so as to thin down to 5 mm thickness.

The final rolling process following the rough rolling process was carried out while the intermediate heat treatment was applied, using the rolling equipment with the circumferential rolling speed of 2 m/min. As shown in FIG. 1(*b*), in the final rolling process, the homogenized ingot was passed through the rolling passage 6 times at the rolling rate of 23% with the sample and rolling temperatures set to 100° C. The material was manufactured by carrying out the final rolling process to thin down to 1 mm thickness, while the intermediate heat treatment was applied with the sample reheating temperature kept at 450° C. for 5 minutes and the sample was air cooled every time the homogenized ingot was passed through the rolling passage. The static crystallization was achieved by the intermediate heat treatment to decrease the degree of orientation of grains.

(Process 4: Solution Treatment)

The solution treated sample was manufactured by carrying out the solution treatment on a plate-like material. The solution treatment was carried out by heating the material at 400° C. for 1 hour.

Figure 11:
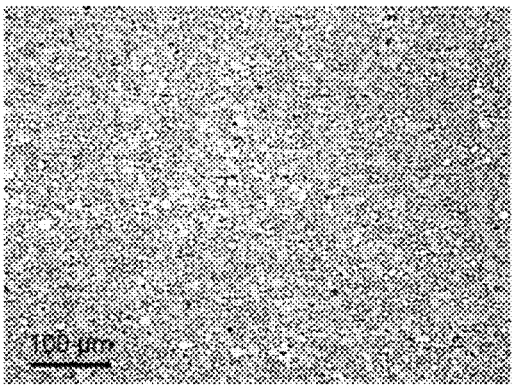
FIG. 11 shows the optical microscope image of the solution treated sample in the Example 3.
Figure 12:
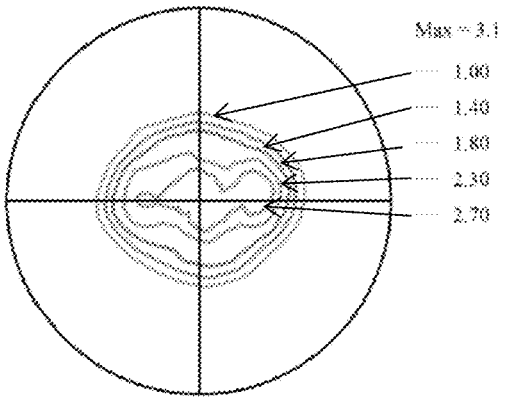
FIG. 12 shows the (0002) pole figure of the solution treated sample in the Example 3.

FIG. 11 shows the optical microscope image of the solution treated sample. The same optical microscope was used as Example 1 etc. The grain size calculated by the linear interception method was 7.5 μm. The grain size was calculated in accordance with ASTM (E112-13) in the same manner as Example 1 etc. FIG. 12 shows the (0002) pole figure of the solution treated sample obtained by the X-ray diffraction. The basal texture intensity at the (0002) pole was 3.4 mrd.

(Process 5: Aging Treatment)

The aging treatment was carried out on the solution treated sample at 170° C. for 4 hours to obtain the magnesium alloy as the aging treated material.

Figure 13:
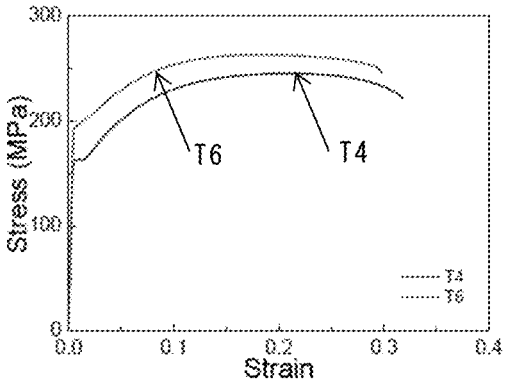
FIG. 13 shows the tensile curves of the solution treated sample and the aging treated material in the Example 3.
Figure 14:
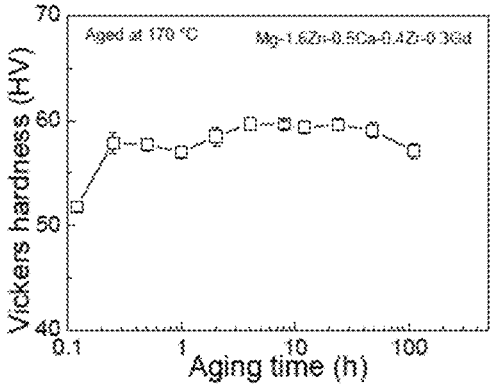
FIG. 14 shows the age hardening curve in the Example 3.

FIG. 13 shows the tensile curves of the solution treated sample (T4) obtained in process 4 and of the aging treated material (T6) obtained in process 5. FIG. 14 shows the age hardening curve of the aging treated material (T6).

As shown in Table 6, the result of the measurement of mechanical strength of the obtained by the solution treated sample shows that the Index Erichsen value was 8.1 mm, the yield strength was 162 MPa, the tensile strength was 245 MPa and the elongation to failure was 32%. The solution treated sample has the excellent room temperature formability. As shown in Table 6, the result of the measurement of mechanical strength obtained by the magnesium alloy shows that the yield strength was 195 MPa, the tensile strength was 263 MPa and the elongation to failure was 30%. Thus, the yield strength of the magnesium alloy was significantly enhanced up to 195 MPa by virtue of the aging treatment.

TABLE 6

| | Yield strength $\delta_{YS}$ (MPa) | Tensile strength $\delta_{UTS}$ (MPa) | Elongation $\varepsilon_{total}$ (%) | Formability Index Erichsen (mm) |
|---|---|---|---|---|
| Solution treated sample (T4) | 162 | 245 | 32 | 8.1 |
| Aging-treated material (T6) | 195 | 263 | 30 | — |

As shown in Table 7, the result of the measurement of mechanical strength obtained by the magnesium alloy shows that the Vickers hardness was 59.7 HV, the time required to reach the peak hardness was 4 hours and the increase in hardness by the aging treatment was 7.9 HV.

TABLE 7

| Peak hardness (HV) | Time required to reach the peak hardness (h) | Increase in hardness (HV) |
|---|---|---|
| 59.7 | 4 | 7.9 |

Example 4

Alloy composition: Mg-0.8Zn-0.5Ca-0.4Zr (Sample A)

Rough rolling process: Sample temperature 100° C., rolling temperature 100° C.

Reheating temperature: At 450° C. for 5 minutes

Solution treatment: At 450° C. for 1 hour

Aging treatment: At 170° C. for 4 hours (Process 1: Casting)

In the same manner as Example 1 etc., the alloy of Mg-0.8Zn-0.5Ca-0.4Zr was melted using the high frequency induction melting furnace and then cast in the mold to manufacture a cast ingot. The thickness of the cast ingot was approximately 10 mm.

(Process 2: Homogenization Treatment)

As shown in FIG. 1(*a*), the cast ingot was heated at 300° C. for 4 hours, the temperature was raised to 450° C. at a rate of 7.5° C./h, and the temperature was kept at 450° C. for 6 hours for heat treatment. Next, the cast ingot was water-quenched for cooling down to carry out the homogenization treatment in order to manufacture the homogenized ingot. In the homogenization treatment, to suppress initial melting of the Mg—Zn phase formed during casting, the cast ingot was heat treated at 300° C. and then was heated treated at 400° C. to 500° C. to homogenize the Zn distribution.

(Process 3: Hot or Warm Working)

In the same manner as Example 1 etc., a material was manufactured by passing the homogenized ingot through the rolling passage capable of applying pressure by the rolling equipment to carry out individually the rough rolling process and the final rolling process.

As shown in FIG. 1(*a*), in the rough rolling process, the homogenized ingot was passed through the rolling passage 4 times at the rolling rate of 15% with the sample and rolling temperatures set to 300° C. using the rolling equipment with circumferential rolling speed of 2 m/min to roll the 10 mm thickness homogenized ingot so as to thin down to 5 mm thickness.

The final rolling process following the rough rolling process was carried out while the intermediate heat treatment was applied, using the rolling equipment with circumferential rolling speed of 2 m/min. As shown in FIG. 1(*a*), in the final rolling process, the homogenized ingot was passed through the rolling passage 6 times at the rolling rate of 23% with the sample and rolling temperatures set to 100° C. The material was manufactured by carrying out the final rolling process to thin down to 1 mm thickness, while the intermediate heat treatment was applied with the sample reheating temperature kept at 450° C. for 5 minutes and the sample was air-cooled every time the homogenized ingot was passed through the rolling passage. The static crystallization was achieved by the intermediate heat treatment to decrease the degree of orientation of grains.

(Process 4: Solution Treatment)

The solution treated sample was manufactured by carrying out the solution treatment on a plate-like material. The solution treatment was carried out by heating the material at 450° C. for 1 hour.

Figure 15:
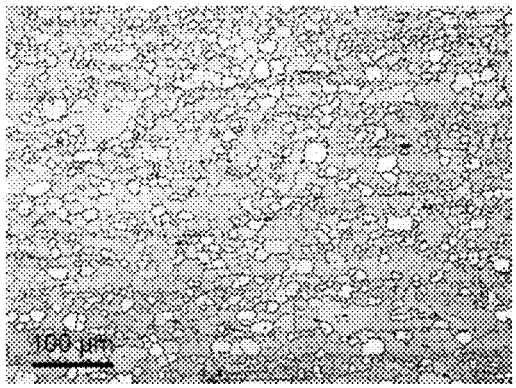
FIG. 15 shows the optical microscope image of the solution treated sample in the Example 4.
Figure 16:
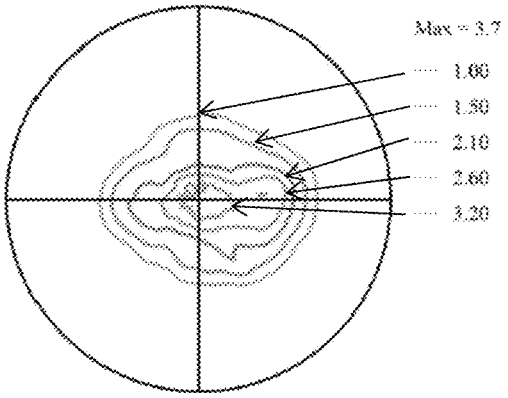
FIG. 16 shows the (0002) pole figure of the solution treated sample in the Example 4.

FIG. 15 shows the optical microscope image of the solution treated sample. The same optical microscope was used as Example 1 etc. The grain size calculated by the linear interception method was 13.7 μm. The grain size was calculated in accordance with ASTM (E112-13) in the same manner as Example 1 etc. FIG. 16 shows the (0002) pole figure of the solution treated sample obtained by the X-ray diffraction. The basal texture intensity of the (0002) pole was 3.7 mrd.

(Process 5: Aging Treatment)

The aging treatment was carried out on the solution treated sample at 170° C. for 4 hours to obtain the magnesium alloy as the aging treated material.

Figure 17:
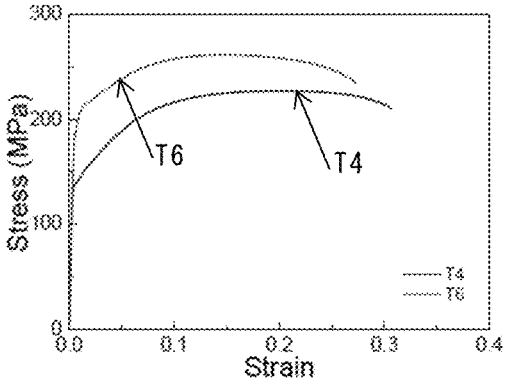
FIG. 17 shows the tensile curves of the solution treated sample and the aging treated material in the Example 4.
Figure 18:
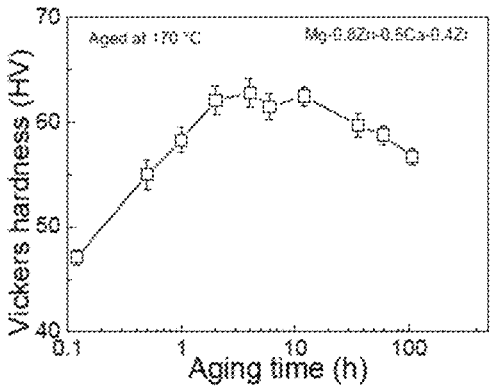
FIG. 18 shows the age hardening curve in the Example 4.

FIG. 17 shows the tensile curves of the solution treated sample (T4) obtained in process 4 and of the aging treated material (T6) obtained in process 5. FIG. 18 shows the age hardening curve of the aging treated material (T6).

As shown in Table 8, the result of the measurement of mechanical strength obtained by the solution treated sample in the same manner as that of Example 1 etc. shows that the Index Erichsen value was 7.7 mm, the yield strength was 136 MPa, the tensile strength was 227 MPa and the elongation to failure was 31%. The solution treated sample has the excellent room temperature formability. As shown in Table 8, the result of the measurement of mechanical strength obtained by the magnesium alloy shows that yield strength was 198 MPa, the tensile strength 261 MPa and the elongation to failure was 27%. Thus, the yield strength of the magnesium alloy was significantly enhanced up to 198 MPa by virtue of the aging treatment.

TABLE 8

| | Yield strength $\delta_{YS}$ (MPa) | Tensile strength $\delta_{UTS}$ (MPa) | Elongation $\varepsilon_{total}$ (%) | Formability Index Erichsen |
|---|---|---|---|---|
| Solution treated sample (T4) | 136 | 227 | 31 | 7.7 |
| Aging-treated material (T6) | 198 | 261 | 27 | — |

As shown in Table 9, the result of the measurement of mechanical strength obtained by the magnesium alloy shows that the Vickers hardness was 62.8 HV, the time required to reach the peak hardness was 4 hours and the increase in hardness by the aging treatment was 15.7 HV.

TABLE 9

| Peak hardness (HV) | Time required to reach the peak hardness (h) | Increase in hardness (HV) |
|---|---|---|
| 62.8 | 4 | 15.7 |

Example 5

Alloy composition: Mg-0.8Zn-0.5Ca-0.4Zr (Sample A)

Rough rolling process: Sample temperature 100° C., rolling temperature 100° C.

Reheating temperature: At 450° C. for 5 minutes

Solution treatment: At 450° C. for 1 hour

Aging treatment: At 170° C. for 4 hours (Process 1: Casting)

In the same manner as Example 1 etc., the alloy of Mg-0.8Zn-0.5Ca-0.4Zr was melted using the high frequency induction melting furnace and then was cast in the mold to manufacture a cast ingot. The thickness of the cast ingot was approximately 10 mm.

(Process 2: Homogenization Treatment)

As shown in FIG. 1(*a*), the cast ingot was heated at 300° C. for 4 hours, the temperature was raised to 450° C. at a rate of 7.5° C./h, and the temperature was kept at 450° C. for 6 hours for heat treatment. Next, the cast ingot was water-quenched for cooling down to carry out the homogenization treatment in order to manufacture the homogenized ingot. In the homogenization treatment, to suppress initial melting of the Mg—Zn phase formed during casting, the cast ingot was heat treated at 300° C. and then was heated treated at 400° C. to 500° C. to homogenize the Zn distribution.

(Process 3: Hot or Warm Working)

In the same manner as Example 1 etc., a material was manufactured by passing the homogenized ingot through the rolling passage capable of applying pressure by the rolling equipment to carry out individually the rough rolling process and the final rolling process.

As shown in FIG. 1(*a*), in the rough rolling process, the homogenized ingot was passed through the rolling passage 4 times at the rolling rate of 15% with the sample and the rolling temperature was set to 300° C. using the rolling equipment with circumferential rolling speed of 2 m/min to roll the 10 mm thickness homogenized ingot so as to thin down to 5 mm thickness.

The final rolling process following the rough rolling process was carried out while the intermediate heat treatment was applied, using the rolling equipment with circumferential rolling speed of 2 m/min. As shown in FIG. 1(*a*), in the final rolling process, the homogenized ingot was passed through the rolling passage 6 times at the rolling rate of 23% with the sample and rolling temperatures set to 100° C. The material was manufactured by carrying out the final rolling process to thin down to 1 mm thickness, while the intermediate heat treatment was applied with the sample reheating temperature kept at 450° C. for 5 minutes and the sample was air-cooled every time the homogenized ingot was passed through the rolling passage. The static crystallization was achieved by the intermediate heat treatment to decrease the degree of orientation of grains.

(Process 4: Solution Treatment)

The solution treated sample was manufactured by carrying out the solution treatment on a plate-like material. The solution treatment was carried out by heating the material at 500° C. for 1 hour.

Figure 19:
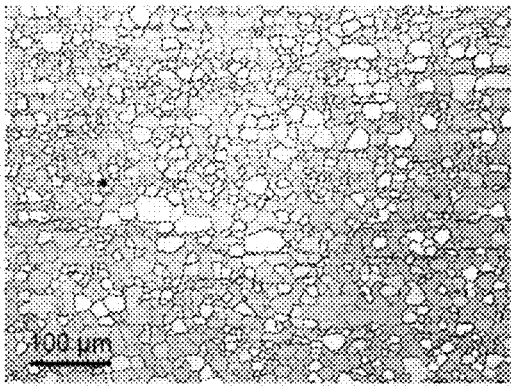
FIG. 19 shows the optical microscope image of the solution treated sample in the Example 5.
Figure 20:
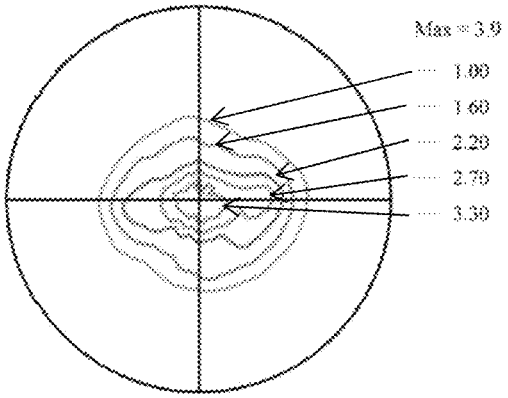
FIG. 20 shows the (0002) pole figure of the solution treated sample in the Example 5.

FIG. 19 shows the optical microscope image of the solution treated sample. The same optical microscope was used as Example 1 etc. The grain size calculated by the linear interception method was 9.0 μm. The grain size was calculated in accordance with ASTM (E112-13) in the same manner as Example 1 etc. FIG. 20 shows the (0002) pole figure of the solution treated sample obtained by the X-ray diffraction. The basal texture intensity of the (0002) pole was 3.2 mrd.

(Process 5: Aging Treatment)

The aging treatment was carried out on the solution treated sample at the aging temperature of 170° C. for 4 hours to obtain the magnesium alloy as the aging treated material.

Figure 21:
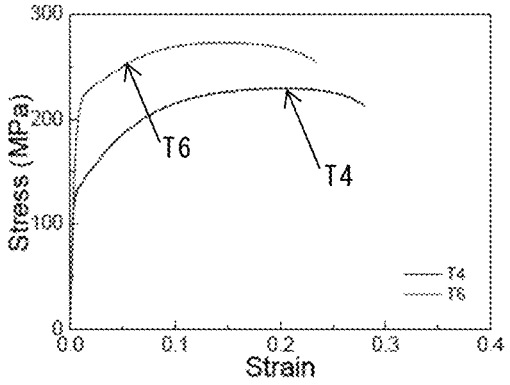
FIG. 21 shows the tensile curves of the solution treated sample and the aging treated material in the Example 5.
Figure 22:
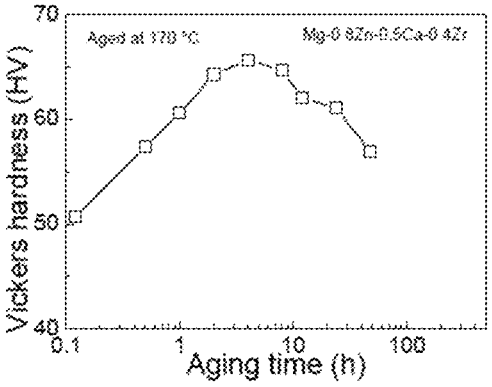
FIG. 22 shows the age hardening curve in the Example 5.

FIG. 21 shows the tensile curves of the solution treated sample (T4) obtained in process 4 and of the aging treated material (T6) obtained in process 5. FIG. 22 shows the age hardening curve of the aging treated material (T6).

As shown in Table 10, the result of the measurement of mechanical strength obtained by the solution treated sample in the same manner as that of Example 1 etc. shows that the Index Erichsen value was 7.5 mm, the yield strength was 129 MPa, the tensile strength was 230 MPa and the elongation to failure was 28%. The solution treated sample has the excellent room temperature formability. As shown in Table 10, the result of the measurement of mechanical strength obtained by the magnesium alloy shows that the yield strength was 218 MPa, the tensile strength was 273 MPa and the elongation to failure was 23%. Thus, the yield strength of the magnesium alloy was significantly enhanced up to 218 MPa by virtue of the aging treatment.

TABLE 10

| | Yield strength $\delta_{YS}$ (MPa) | Tensile strength $\delta_{UTS}$ (MPa) | Elongation $\varepsilon_{total}$ (%) | Formability Index Erichsen |
|---|---|---|---|---|
| Solution treated sample (T4) | 129 | 230 | 28 | 7.5 |
| Aging-treated material (T6) | 218 | 273 | 23 | — |

As shown in Table 11, the result of the measurement of mechanical strength obtained by the magnesium alloy shows that the Vickers hardness was 65.7 HV, the time required to reach the peak hardness was 4 hours and the increase in hardness by the aging treatment was 15 HV.

TABLE 11

| Peak hardness (HV) | Time required to reach the peak hardness (h) | Increase in hardness (HV) |
|---|---|---|
| 65.7 | 4 | 15 |

Example 6

Alloy composition: Mg-1.6Zn-0.5Ca-0.4Zr (Sample B)

Rough rolling process: Sample temperature 100° C., rolling temperature 100° C.

Reheating temperature: At 450° C. for 5 minutes

Solution treatment: At 430° C. for 1 hour

Aging treatment: At 170° C. for 4 hours (Process: Casting)

In the same manner in Example 1 etc., the alloy of Mg-1.6Zn-0.5Ca-0.4Zr was melted using the high frequency induction melting furnace and then was cast in the mold to manufacture the cast ingot. The thickness of the cast ingot was approximately 10 mm.

(Process 2: Homogenization Treatment)

As shown in FIG. 1(*b*), the cast ingot was heated at 300° C. for 4 hours, the temperature was raised to 450° C. at a rate of 7.5° C./h, and the temperature was kept at 450° C. for 6 hours for heat treatment. Next, the cast ingot was removed from the heat treatment furnace, air cooled down to 300° C. and water-quenched for homogenization treatment to manufacture the homogenized ingot. In the homogenization treatment, to suppress initial melting of the Mg—Zn phase formed during casting, the cast ingot was heat treated at 300° C. and then was heated treated at 400° C. to 500° C. to homogenize Zn distribution.

(Process 3: Hot or Warm Working)

In the same manner in Example 1 etc., the material was manufactured by passing the homogenized ingot through the rolling passage capable of applying pressure by the rolling equipment to carry out individually the rough rolling process and the final rolling process.

As shown in FIG. 1(*b*), in the rough rolling process, the homogenized ingot was passed through the rolling passage 4 times at the rolling rate of 15% with the sample and rolling temperatures was set to 300° C. using the rolling equipment with circumferential rolling speed of 2 m/min to roll the 10 mm thickness homogenized ingot so as to thin down to 5 mm thickness.

The final rolling process following the rough rolling process was carried out while the intermediate heat treatment was applied, using the rolling equipment with circumferential rolling speed of 2 m/min. As shown in FIG. 1(*b*), in the final rolling process, the homogenized ingot was passed through the rolling passage 6 times at the rolling rate of 23% with the sample and rolling temperatures set to 100° C. The material was manufactured by carrying out the final rolling process to thin down to 1 mm thickness, while the intermediate heat treatment was applied with the sample reheating temperature kept at 450° C. for 5 minutes and the sample was air-cooled every time the homogenized ingot was passed through the rolling passage. The static crystallization was achieved by the intermediate heat treatment to decrease the degree of orientation of grains.

(Process 4: Solution Treatment)

The solution treated sample was manufactured by carrying out the solution treatment on a plate-like material. The solution treatment was carried out by heating the material at 430° C. for 1 hour.

Figure 23:
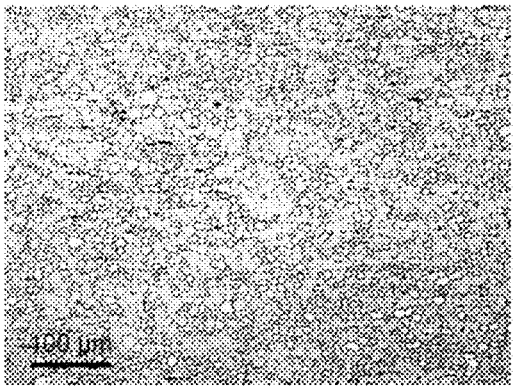
FIG. 23 shows the optical microscope image of the solution treated sample material in the Example 6.
Figure 24:
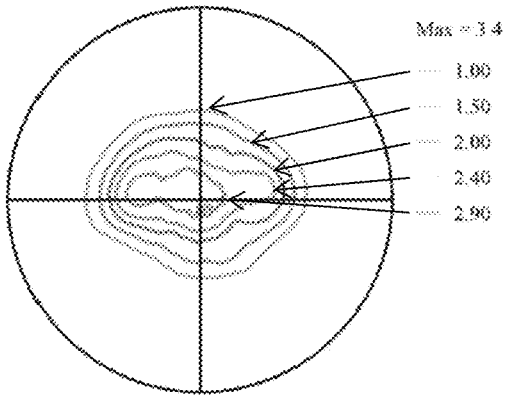
FIG. 24 shows the (0002) pole figure of the solution treated sample in the Example 6.

FIG. 23 shows the optical microscope image of the solution treated sample. The same optical microscope was used as Example 1 etc. The grain size calculated by the linear interception method was 8.2 μm. The grain size was calculated in accordance with ASTM (E112-13) in the same manner as Example 1 etc. FIG. 24 shows the (0002) pole figure of the solution treated sample obtained by X-ray diffraction. The basal texture intensity of the (0002) pole was 3.4 mrd.

(Process 5: Aging Treatment)

The aging treatment was carried out on the solution treated sample at the aging temperature of 170° C. for 4 hours to obtain the Magnesium alloy as the aging treated material.

Figure 25:
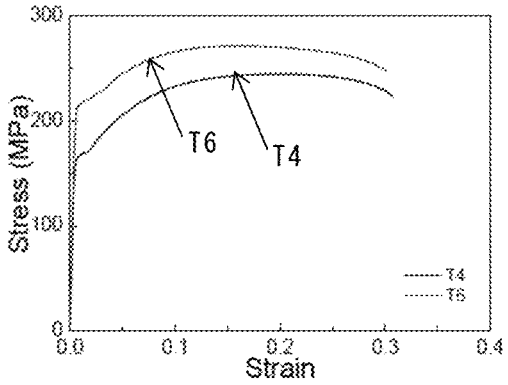
FIG. 25 shows the tensile curves of the solution treated sample and the aging treated material in the Example 6.
Figure 26:
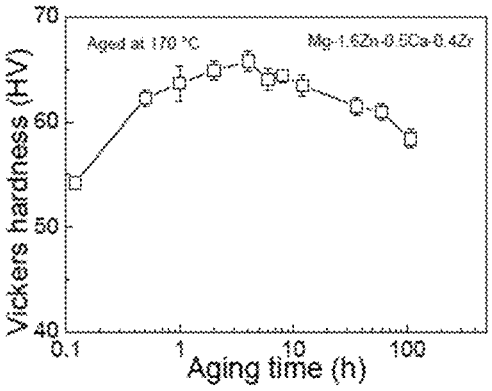
FIG. 26 shows the age hardening curve in the Example 6.

FIG. 25 shows the tensile curves of the solution treated sample (T4) obtained in process 4 and of the aging treated material (T6) obtained in process 5. FIG. 26 shows the age hardening curve of the aging treated material (T6) obtained in process 5.

As shown in Table 12, the result of the measurement of mechanical strength obtained by solution treated sample in the same manner as that of Example 1 etc. shows that the Index Erichsen value was 8.0 mm, the yield strength was 165 MPa, the tensile strength was 245 MPa and the elongation to failure was 31%. The solution treated sample has the excellent room temperature formability. As shown in Table 12, the result of the measurement of mechanical strength of the obtained magnesium alloy shows that the yield strength was 215 MPa, the tensile strength was 272 MPa and the elongation to failure was 30%. Thus, the yield strength of the magnesium alloy was significantly enhanced up to 215 MPa by virtue of the aging treatment.

TABLE 12

| | Yield strength $\delta_{YS}$ (MPa) | Tensile strength $\delta_{UTS}$ (MPa) | Elongation $\varepsilon_{total}$ (%) | Formability Index Erichsen |
|---|---|---|---|---|
| Solution treated sample (T4) | 165 | 245 | 31 | 8.0 |
| Aging-treated material (T6) | 215 | 272 | 30 | — |

As shown in Table 13, the result of the measurement of mechanical strength obtained by the magnesium alloy shows that the Vickers hardness was 65.8 HV, the time required to reach the peak hardness was 4 hours and the increase in hardness by the aging treatment was 11.6 HV.

TABLE 13

| Peak hardness (HV) | Time required to reach the peak hardness (h) | Increase in hardness (HV) |
|---|---|---|
| 65.8 | 4 | 11.6 |

Example 7

Alloy composition: Mg-1.6Zn-0.5Ca-0.4Zr-0.3Gd (Sample C)

Rough rolling process: Sample temperature 100° C., rolling temperature 100° C.

Reheating temperature: At 450° C. for 5 minutes

Solution treatment: At 430° C. for 1 hour

Aging treatment: At 170° C. for 4 hours

Adding Gd allows the degree of orientation of grains at the bottom of the magnesium matrix to be further decreased, hence, more excellent room temperature formability is expected.

(Process 1: Casting)

In the same manner as Example 1 etc., the alloy of Mg-1.6Zn-0.5Ca-0.4Zr-0.3Gd was melted using the high frequency induction melting furnace and then was cast in the mold to manufacture the cast ingot. The thickness of the cast ingot was approximately 10 mm.

(Process 2: Homogenization Treatment)

As shown in FIG. 1(*b*), the cast ingot was heated at 300° C. for 4 hours, the temperature was raised to 450° C. at a rate of 7.5° C./h, and the temperature was kept at 450° C. for 6 hours for heat treatment. Next, the cast ingot was removed from the heat treatment furnace, air cooled down to 300° C.

and water-quenched for homogenization treatment to manufacture the homogenized ingot. In the homogenization treatment, to suppress initial melting of the Mg—Zn phase formed during casting, the cast ingot was heat treated at 300° C. and then was heat treated at 400° C. to 500° C. to homogenize the Zn distribution.

(Process 3: Hot or Warm Working)

In the same manner as Example 1 etc., the material was manufactured by passing the homogenized ingot through the rolling passage capable of applying pressure by the rolling equipment to carry out individually the rough rolling process and the final rolling process.

As shown in FIG. 1(*b*), in the rough rolling process, the homogenized ingot was passed through the rolling passage 4 times at the rolling rate of 15% with the sample and rolling temperatures set to 300° C. using the rolling equipment with circumferential rolling speed of 2 m/min to roll the 10 mm thickness homogenized ingot so as to thin down to 5 mm thickness.

The final rolling process following the rough rolling process was carried out while the intermediate heat treatment was applied, using the rolling equipment with circumferential rolling speed of 2 m/min. As shown in FIG. 1(*b*), in the final rolling process, the homogenized ingot was passed through the rolling passage 6 times at the rolling rate of 23% with the sample and rolling temperatures set to 100° C. The material was manufactured by carrying out the final rolling process to thin down to 1 mm thickness, while the intermediate heat treatment was applied with the sample reheating temperature kept at 450° C. for 5 minutes and the sample was air-cooled every time the homogenized ingot was passed through the rolling passage. The static crystallization was achieved by the intermediate heat treatment to decrease the degree of orientation of grains.

(Process 4: Solution Treatment)

The solution treated sample was manufactured by carrying out the solution treatment on a plate-like material. The solution treatment was carried out by heating the material at 430° C. for 1 hour.

Figure 27:
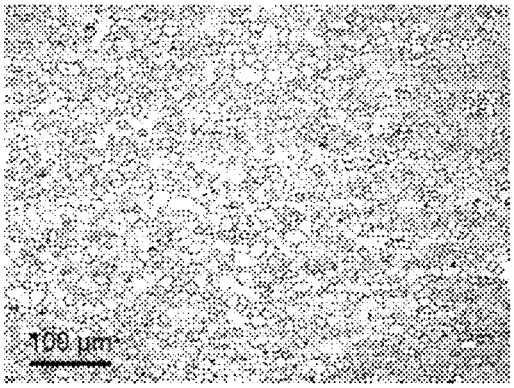
FIG. 27 shows the optical microscope image of the solution treated sample in the Example 7.
Figure 28:
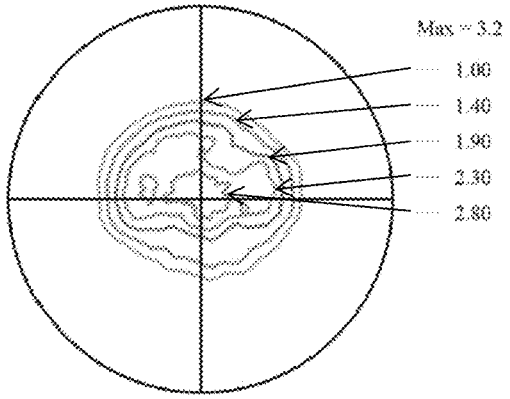
FIG. 28 shows the (0002) pole figure of the solution treated sample in the Example 7.

FIG. 27 shows the optical microscope image of the solution treated sample. The same optical microscope was used as Example 1 etc. The grain size calculated by the linear interception method was 9.0 μm. The grain size was calculated in accordance with ASTM (E112-13) in the same manner as Example 1 etc. FIG. 28 shows the (0002) pole figure of the solution treated sample obtained by X-ray diffraction (0002). The basal texture intensity of the (0002) pole was 3.2 mrd.

(Process 5: Aging Treatment)

The aging treatment was carried out on the solution treated sample at the aging temperature of 170° C. for 4 hours to obtain the magnesium alloy as the aging treated material.

Figure 29:
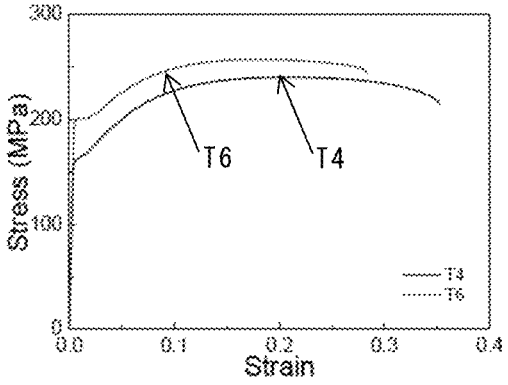
FIG. 29 shows the tensile curves of the solution treated sample and the aging treated material in the Example 7.
Figure 30:
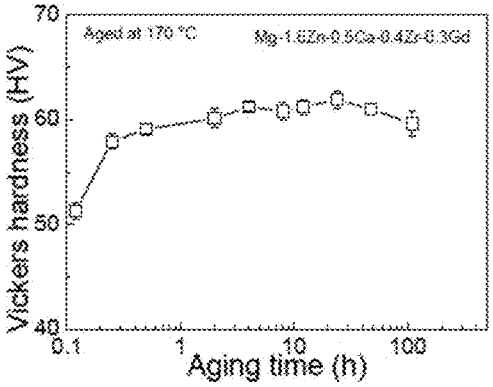
FIG. 30 shows the age hardening curve according to the Example 7.

FIG. 29 shows the tensile curves of the solution treated sample (T4) obtained in process 4 and of the aging treated material (T6) obtained in process 5. FIG. 30 shows the age hardening curve of the aging treated material (T6) obtained in process 5.

As shown in Table 14, the result of the measurement of mechanical strength obtained by the solution treated sample in the same manner as that of Example 1 etc. shows that the Index Erichsen value was 8.1 mm, the yield strength was 161 MPa, the tensile strength was 241 MPa and the elongation to failure was 35%. The solution treated sample has the excellent room temperature formability. As shown in Table 14, the result of the measurement of mechanical strength obtained by the magnesium alloy shows that the yield strength was 200 MPa, the tensile strength was 257 MPa and the elongation to failure was 28%. Thus, the yield strength of the magnesium alloy was significantly enhanced up to 200 MPa by the aging treatment.

In Example 7, the same Sample C as Example 3 was used but the solution treatment temperature was set to 430° C. different from that in Example 3, where the solution treatment temperature was 400° C. Under the same conditions as those in Example 3 excluding the solution treatment temperature, the magnesium alloy was manufactured. In Example 7 where 0.3 wt % Gd was added in the same manner as Example 3, almost the same levels of mechanical strength and the Index Erichsen value as those in Example 3 were achieved.

TABLE 14

| | Yield strength $\delta_{YS}$ (MPa) | Tensile strength $\delta_{UTS}$ (MPa) | Elongation $\varepsilon_{total}$ (%) | Formability Index Erichsen |
|---|---|---|---|---|
| Solution treated sample (T4) | 161 | 241 | 35 | 8.1 |
| Aging-treated material (T6) | 200 | 257 | 28 | — |

As shown in Table 15, the result of the measurement of mechanical strength obtained by the magnesium alloy shows that the Vickers hardness was 61.2 HV, the time required to reach the peak hardness was 4 hours and the increase in hardness by the aging treatment was 9.9 HV.

TABLE 15

| Peak hardness (HV) | Time required to reach the peak hardness (h) | Increase in hardness (HV) |
|---|---|---|
| 61.2 | 4 | 9.9 |

Comparative Example 1

Alloy composition: Mg-0.8Zn-0.8Ca-0.4Zr (Sample D)

Rough rolling process: Sample temperature 100° C., rolling temperature 100° C.

Reheating temperature: At 450° C. for 5 minutes

Solution treatment: At 400° C. for 1 hour

Aging treatment: At 170° C. for 2 hours (Process 1: Casting)

In the same manner as Example 1 etc., the alloy of Mg-0.8Zn-0.8Ca-0.4Zr was melted using the high frequency induction melting furnace and then was cast in the mold to manufacture a cast ingot. The thickness of the cast ingot was approximately 10 mm.

(Process 2: Homogenization Treatment)

As shown in FIG. 1(*a*), the cast ingot was heated at 300° C. for 4 hours, the temperature was raised to 450° C. at a rate of 7.5° C./h, and the temperature was kept at 450° C. for 6 hours for heat treatment. Next, the cast ingot was water-quenched for cooling down to carry out the homogenization treatment in order to manufacture the homogenized ingot. In the homogenization treatment, to suppress initial melting of the Mg—Zn phase formed during casting, the cast ingot was heat treated at 300° C. and then was heated treated at 400° C. to 500° C. to homogenize the Zn distribution.

(Process 3: Hot or Warm Working)

In the same manner as Example 1 etc., the material was manufactured by passing the homogenized ingot through a rolling passage capable of applying pressure by the rolling equipment to carry out individually the rough rolling process and the final rolling process.

As shown in FIG. 1(*a*), in the rough rolling process, the homogenized ingot was passed through the rolling passage 4 times at the rolling rate of 15% with the sample and rolling temperatures set to 300° C. using the rolling equipment with circumferential rolling speed of 2 m/min to roll the 10 mm thickness homogenized ingot so as to thin down to 5 mm thickness.

The final rolling process following the rough rolling process was carried out while the intermediate heat treatment was applied, using the rolling equipment with circumferential rolling speed of 2 m/min. As shown in FIG. 1(*a*), in the final rolling process, the homogenized ingot was passed through the rolling passage 6 times at the rolling rate of 23% with the sample and the rolling temperatures was set to 100° C. The material was manufactured by carrying out the final rolling process to thin down to 1 mm thickness, while the intermediate heat treatment was applied with the sample reheating temperature kept at 450° C. for 5 minutes and the sample was air-cooled every time the homogenized ingot was passed through the rolling passage. The static crystallization was achieved by the intermediate heat treatment to decrease the degree of orientation of grains.

(Process 4: Solution Treatment)

The solution treated sample was manufactured by carrying out the solution treatment on a plate-like material. The solution treatment was carried out by heating the material at 400° C. for 1 hour.

Figure 31:
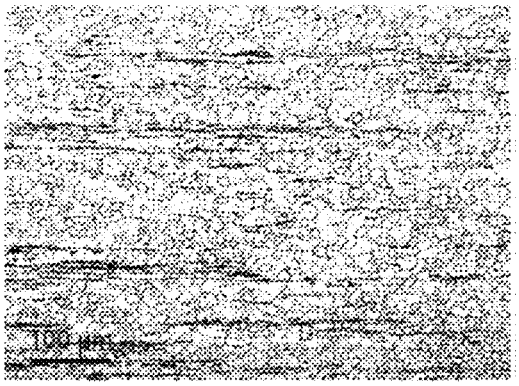
FIG. 31 shows the optical microscope image of the solution treated sample in the Comparative Example 1.
Figure 32:
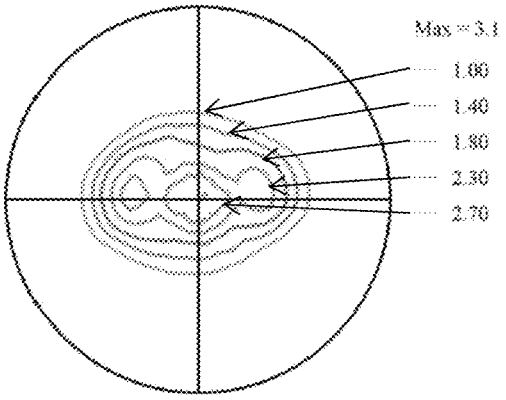
FIG. 32 shows the (0002) pole figure of the solution treated sample in the Comparative Example 1.

FIG. 31 shows the optical microscope image of the solution treated sample. The same optical microscope was used as Example 1 etc. The grain size calculated by the linear interception method was 10.0 μm. The grain size was calculated in accordance with ASTM (E112-13) in the same manner as Example 1 etc. FIG. 32 shows the (0002) pole figure of the solution treated sample obtained by X-ray diffraction. The basal texture intensity of the (0002) pole was 3.1 mrd.

(Process 5: Aging Treatment)

The aging treatment was carried out on the solution treated sample at 170° C. for 2 hours to obtain the magnesium alloy as the aging treated material.

Figure 33:
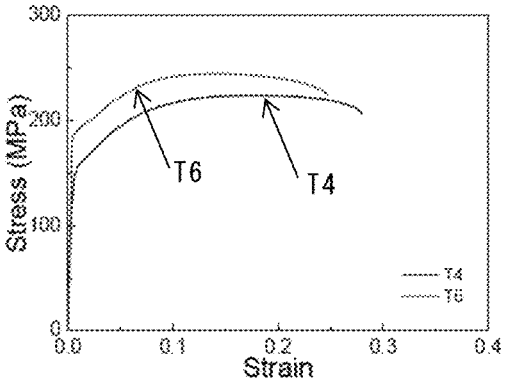
FIG. 33 shows the tensile curves of solution treated sample and the aging treated material in the Comparative Example 1.
Figure 34:
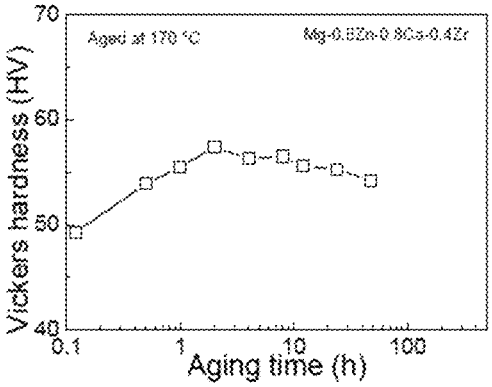
FIG. 34 shows the age hardening curve in the Comparative Example 1.

FIG. 33 shows the tensile curves of the solution treated sample (T4) obtained in process 4 and of the aging treated material (T6) obtained in process 5. FIG. 34 shows the age hardening curve of the aging treated material (T6) obtained in process 5.

As shown in Table 16, the result of the measurement of mechanical strength obtained by the solution treated sample in the same manner as that of Examples 1 etc. shows that the Index Erichsen value was 6.5 mm, the yield strength was 148 MPa, the tensile strength was 224 MPa and the elongation to failure was 28%. The solution treated sample has the excellent room temperature formability. As shown in Table 16, the result of the measurement of mechanical strength obtained by the magnesium alloy shows that the yield strength 187 MPa, the tensile strength was 245 MPa and the elongation to failure was 25%. Thus, the yield strength of the magnesium alloy was significantly enhanced up to 187 MPa by virtue of the aging treatment.

TABLE 16

| | Yield strength $\delta_{YS}$ (MPa) | Tensile strength $\delta_{UTS}$ (MPa) | Elongation $\varepsilon_{total}$ (%) | Formability Index Erichsen |
|---|---|---|---|---|
| Solution treated sample (T4) | 148 | 224 | 28 | 6.5 |
| Aging-treated material (T6) | 187 | 245 | 25 | — |

As shown in Table 17, the result of the measurement of mechanical strength obtained by the magnesium alloy shows that the Vickers hardness was 57.4 HV, the time required to reach the peak hardness was 2 hours and the increase in hardness by the aging treatment was 8.1 HV.

TABLE 17

| Peak hardness (HV) | Time required to reach the peak hardness (h) | Increase in hardness (HV) |
|---|---|---|
| 57.4 | 2 | 8.1 |

Comparative Example 2

Alloy composition: Mg-0.8Zn-0.8Ca-0.2Zr (Sample E)

Rough rolling process: Sample temperature 100° C., rolling temperature 100° C.

Reheating temperature: At 450° C. for 5 minutes

Solution treatment: At 400° C. for 1 hour

Aging treatment: At 170° C. for 4 hours (Process 1: Casting)

In the same manner as Example 1 etc., the alloy of Mg-0.8Zn-0.8Ca-0.2Zr was melted using the high frequency induction melting furnace and then was cast in the mold to manufacture a cast ingot. The thickness of the cast ingot was approximately 10 mm.

(Process 2: Homogenization Treatment)

As shown in FIG. 1(*a*), the cast ingot was heated at 300° C. for 4 hours, the temperature was raised to 450° C. at a rate of 7.5° C./h, and the temperature was kept at 450° C. for 6 hours for heat treatment. Next, the cast ingot was water-quenched for cooling down to carry out the homogenization treatment in order to manufacture the homogenized ingot. In the homogenization treatment, to suppress initial melting of the Mg—Zn phase formed during casting, the cast ingot was heat treated at 300° C. and then was heated treated at 400° C. to 500° C. to homogenize the Zn distribution.

(Process 3: Hot or Warm Working)

In the same manner as Example 1 etc., the material was manufactured by passing the homogenized ingot through the rolling passage capable of applying pressure by the rolling equipment to carry out individually the rough rolling process and the final rolling process.

As shown in FIG. 1(*a*), in the rough rolling process, the homogenized ingot was passed through the rolling passage 4 times at the rolling rate of 15% with the sample and rolling temperatures was set to 300° C. using the rolling equipment with the circumferential rolling speed of 2 m/min to roll the 10 mm thickness homogenized ingot so as to thin down 5 mm thickness.

The final rolling process following the rough rolling process was carried out while the intermediate heat treatment was applied, using the rolling equipment with the circumferential rolling speed of 2 m/min. As shown in FIG.

1(*a*), in the final rolling process, the homogenized ingot was passed through the rolling passage 6 times at the rolling rate of 23% with the sample and rolling temperatures set to 100° C. The material was manufactured by carrying out the final rolling process to thin down to 1 mm thickness, while the intermediate heat treatment was applied with the sample reheating temperature kept at 450° C. for 5 minutes and the sample was air-cooled every time the homogenized ingot was passed through the rolling passage. The static crystallization was achieved by the intermediate heat treatment to decrease the degree of orientation of grains.

(Process 4: Solution Treatment)

The solution treated sample was manufactured by carrying out the solution treatment on a plate-like material. The solution treatment was carried out by heating the material at 400° C. for 1 hour.

Figure 35:
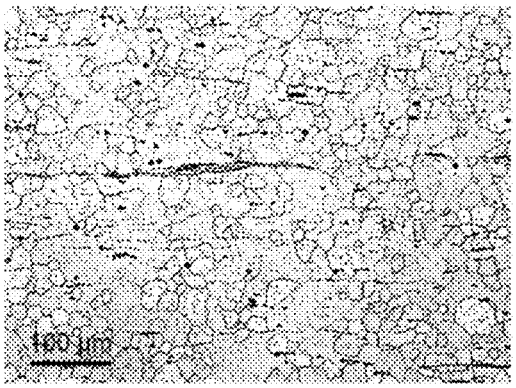
FIG. 35 shows the optical microscope image of the solution treated sample material in the Comparative Example 2.
Figure 36:
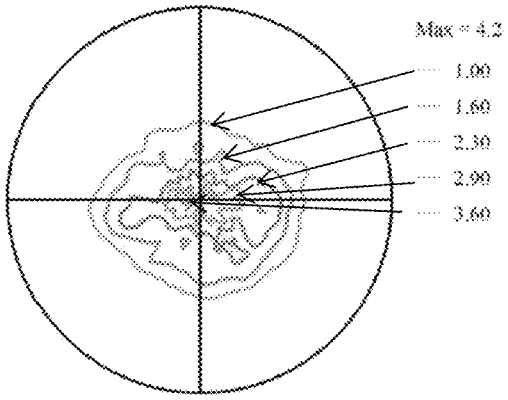
FIG. 36 shows the (0002) pole figure of the solution treated sample in the Comparative Example 2.

FIG. 35 shows the optical microscope image of the solution treated sample. The same optical microscope was used as Example 1 etc. The grain size calculated by the linear interception method was 20.3 μm. The grain size was calculated in accordance with ASTM (E112-13) in the same manner as Example 1 etc. FIG. 36 shows the (0002) pole figure of the solution treated sample obtained by X-ray diffraction. The basal texture intensity of the (0002) pole was 4.2 mrd.

(Process 5: Aging Treatment)

The aging treatment was carried out on the solution treated sample at 170° C. for 4 hours to obtain the magnesium alloy as the aging treated material.

Figure 37:
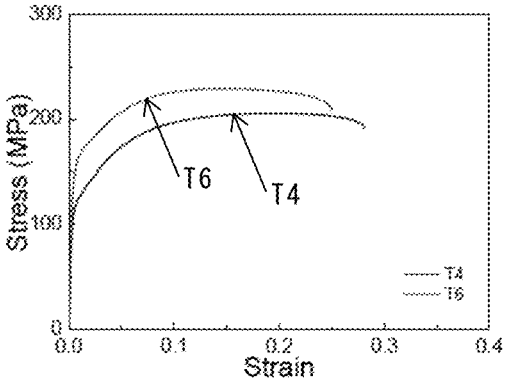
FIG. 37 shows the tensile curves of the solution treated sample and the aging treated material in the Comparative Example 2.
Figure 38:
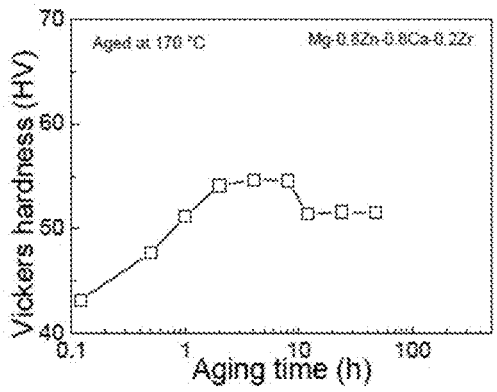
FIG. 38 shows the age hardening curve in the Comparative Example 2.

FIG. 37 shows the tensile curves of the solution treated sample (T4) obtained in process 4 and of the aging treated material (T6) obtained in process 5. FIG. 38 shows the age hardening curve of the aging treated material (T6) obtained in process 5.

As shown in Table 18, the result of the measurement of mechanical strength obtained by the solution treated sample in the same manner as that of Examples 1 etc. shows that the Index Erichsen value was 7.0 mm, the yield strength was 118 MPa, the tensile strength was 206 MPa and the elongation to failure was 28%. The solution treated sample has the excellent room temperature formability. As shown in Table 18, the result of the measurement of mechanical strength obtained by the magnesium alloy shows that the yield strength was 155 MPa, the tensile strength was 229 MPa and the elongation to failure was 25%. Thus, the yield strength of the magnesium alloy was significantly enhanced up to 155 MPa by virtue of the aging treatment.

TABLE 18

| | Yield strength $\delta_{YS}$ (MPa) | Tensile strength $\delta_{UTS}$ (MPa) | Elongation $\varepsilon_{total}$ (%) | Formability Index Erichsen |
|---|---|---|---|---|
| Solution treated sample (T4) | 118 | 206 | 28 | 7.0 |
| Aging-treated material (T6) | 155 | 229 | 25 | — |

As shown in Table 19, the result of the measurement of mechanical strength obtained by the magnesium alloy shows that the Vickers hardness was 54.7 HV, the time required to reach the peak hardness was 4 hours and the increase in hardness by the aging treatment was 11.5 HV.

TABLE 19

| Peak hardness (HV) | Time required to reach the peak hardness (h) | Increase in hardness (HV) |
|---|---|---|
| 54.7 | 4 | 11.5 |

Comparative Example 3

Alloy composition: Mg-1.6Zn-0.4Zr (Sample F)

Rough rolling process: Sample temperature 100° C., rolling temperature 100° C.

Reheating temperature: At 450° C. for 5 minutes

Solution treatment: At 400° C. for 1 hour

Aging treatment: At 170° C. for 0.5 hours (Process 1: Casting)

In the same manner as Example 1 etc., the alloy of Mg-1.6Zn-0.4Zr was melted using the high frequency induction melting furnace and then was cast in the mold to manufacture a cast ingot. The thickness of the cast ingot was approximately 10 mm.

(Process 2: Homogenization Treatment)

As shown in FIG. 1(*b*), the cast ingot was heated at 300° C. for 4 hours, the temperature was raised to 450° C. at a rate of 7.5° C./h, and the temperature was kept at 450° C. for 6 hours for heat treatment. Next, the cast ingot was removed from the heat treatment furnace, air cooled down to 300° C. and water-quenched for homogenization treatment to manufacture the homogenized ingot. In the homogenization treatment, to suppress initial melting of the Mg—Zn phase formed during casting, the cast ingot was heat treated at 300° C. and then was heated treated at 400° C. to 500° C. to homogenize the Zn distribution.

(Process 3: Hot or Warm Working)

In the same manner as Example 1 etc., the material was manufactured by passing the homogenized ingot through the rolling passage capable of applying pressure by the rolling equipment to carry out individually the rough rolling process and the final rolling process.

As shown in FIG. 1(*b*), in the rough rolling process, the homogenized ingot was passed through the rolling passage 4 times at the rolling rate of 15% with the sample and rolling temperatures was set to 300° C. using the rolling equipment with circumferential rolling speed of 2 m/min to roll the 10 mm thickness homogenized ingot so as to thin down to 5 mm thickness.

The final rolling process following the rough rolling process was carried out while the intermediate heat treatment was applied, using the rolling equipment with circumferential rolling speed of 2 m/min. As shown in FIG. 1(*b*), in the final rolling process, the homogenized ingot was passed through the rolling passage 6 times at the rolling rate of 23% with the sample and rolling temperatures set to 100° C. The material was manufactured by carrying out the final rolling process to thin down to 1 mm thickness, while the intermediate heat treatment was applied with the sample reheating temperature kept at 450° C. for 5 minutes and the sample was air-cooled every time the homogenized ingot was passed through the rolling passage. The static crystallization was achieved by the intermediate heat treatment to decrease the degree of orientation of grains.

(Process 4: Solution Treatment)

The solution treated sample was manufactured by carrying out the solution treatment on a plate-like material. The solution treatment was carried out by heating the material at 400° C. for 1 hour.

Figure 39:
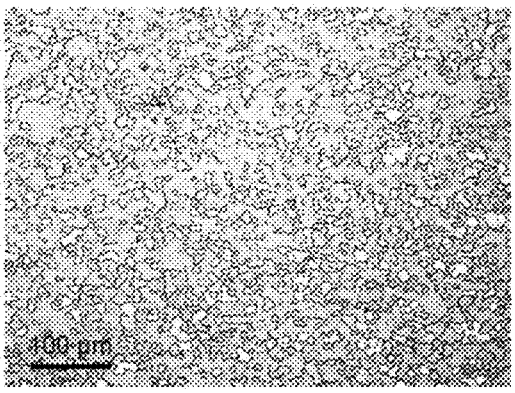
FIG. 39 shows the optical microscope image of the solution treated sample in the Comparative Example 3.
Figure 40:
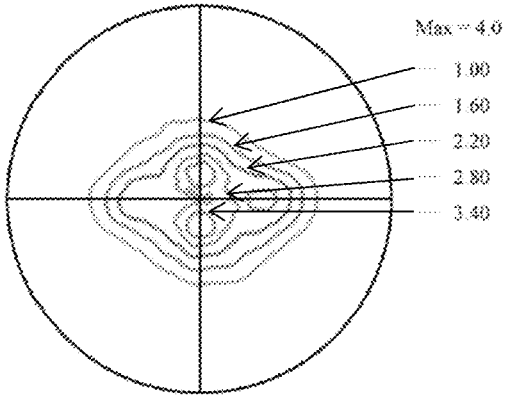
FIG. 40 shows the (0002) pole figure of the solution treated sample in the Comparative Example 3.

FIG. 39 shows the optical microscope image of the solution treated sample. The same optical microscope was used as Example 1 etc. The grain size calculated by the linear interception method was 11.5 μm. The grain size was calculated in accordance with ASTM (E112-13) in the same manner as Examples 1 etc. FIG. 40 shows the (0002) pole figure of the solution treated sample obtained by the X-ray diffraction. The basal texture intensity of the (0002) pole was 4.0 mrd.

(Process 5: Aging Treatment)

The aging treatment was carried out on the solution treated sample at the aging temperature of 170° C. for 4 hours to obtain the magnesium alloy as the aging treated material.

Figure 41:
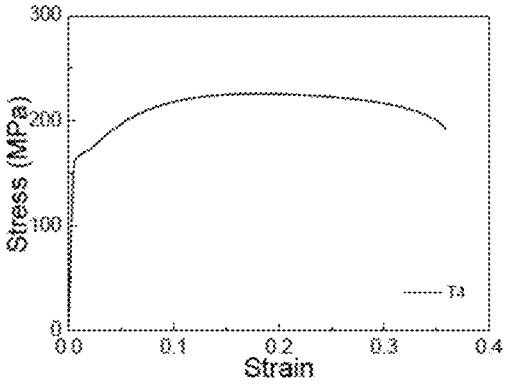
FIG. 41 shows the tensile curve of the solution treated sample in the Comparative Example 3.
Figure 42:
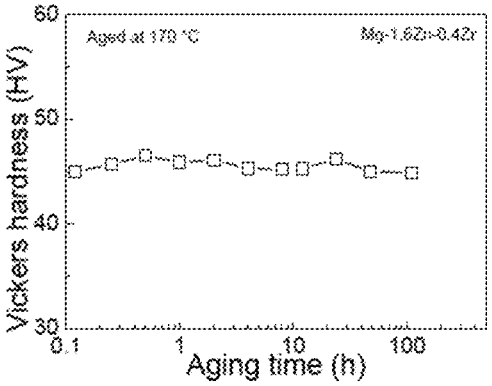
FIG. 42 shows the age hardening curve in the Comparative Example 3.

FIG. 41 shows the tensile curve of the solution treated sample (T4) obtained in process 4. FIG. 42 shows the age hardening curve of the aging treated material (T6) obtained in process 5.

As shown in Table 20, the result of the measurement of mechanical strength obtained by the solution treated sample in the same manner as that of Example 1 etc. shows that the Index Erichsen value is 6.5 mm, the yield strength was 164 MPa, the tensile strength was 226 MPa and the elongation to failure was 36%. The solution treated sample has the excellent room temperature formability.

TABLE 20

| | Yield strength $\delta_{YS}$ (MPa) | Tensile strength $\delta_{UTS}$ (MPa) | Elongation $\varepsilon_{total}$ (%) | Formability Index Erichsen (mm) |
|---|---|---|---|---|
| Solution-treated material (T4) | 164 | 226 | 36 | 6.5 |

The result of the measurement of a variation of the magnesium alloy in Vickers hardness relative to the aging time showed approximately 46.5 HV without being age hardened.

Comparative Example 4

Alloy composition: Mg-0.8Zn-0.5Ca-0.4Zr (Sample A)

Rough rolling process: Sample temperature 100° C., rolling temperature 100° C.

Reheating temperature: At 450° C. for 5 minutes

Solution treatment: At 350° C. for 1 hour

Aging treatment: At 170° C. for 2 hours (Process 1: Casting)

In the same manner as Example 1 etc., the alloy of Mg-0.8Zn-0.5Ca-0.4Zr was melted using the high frequency induction melting furnace and then was cast in the mold to manufacture a cast ingot. The thickness of the cast ingot was approximately 10 mm.

(Process 2: Homogenization Treatment)

As shown in FIG. 1(*a*), the cast ingot was heated at 300° C. for 4 hours, the temperature was raised to 450° C. at a rate of 7.5° C./h, and the temperature was kept at 450° C. for 6 hours for heat treatment. Next, the cast ingot was water-quenched for cooling down to carry out homogenization treatment in order to manufacture the homogenized ingot. In the homogenization treatment, to suppress initial melting of the Mg—Zn phase formed during casting, the cast ingot was heat treated at 300° C. and then was heat treated at 400° C. to 500° C. to homogenize the Zn distribution.

(Process 3: Hot or Warm Working)

In the same manner as Examples 1 etc., a material was manufactured by passing the homogenized ingot through the rolling passage capable of applying pressure by the rolling equipment to carry out individually the rough rolling process and the final rolling process.

As shown in FIG. 1(*a*), in the rough rolling process, the homogenized ingot was passed through the rolling passage 4 times at the rolling rate of 15% with the sample and rolling temperatures was set to 300° C. using the rolling equipment with circumferential rolling speed of 2 m/min to roll the 10 mm thickness homogenized ingot so as to thin down to 5 mm thickness.

The final rolling process following the rough rolling process was carried out while the intermediate heat treatment was applied, using the rolling equipment with circumferential rolling speed of 2 m/min. As shown in FIG. 1(*a*), in the final rolling process, the homogenized ingot was passed through the rolling passage 6 times at the rolling rate of 23% with the sample and rolling temperatures set to 100° C. The material was manufactured by carrying out the final rolling process to thin down to 1 mm thickness, while the intermediate heat treatment was applied with the sample reheating temperature kept at 450° C. for 5 minutes and the sample was air-cooled every time the homogenized ingot was passed through the rolling passage. The static crystallization was achieved by the intermediate heat treatment to decrease the degree of orientation of grains.

(Process 4: Solution Treatment)

The solution treated sample was manufactured by carrying out the solution treatment on a plate-like material. The solution treatment was carried out by heating the material at 350° C. for 1 hour.

Figure 43:
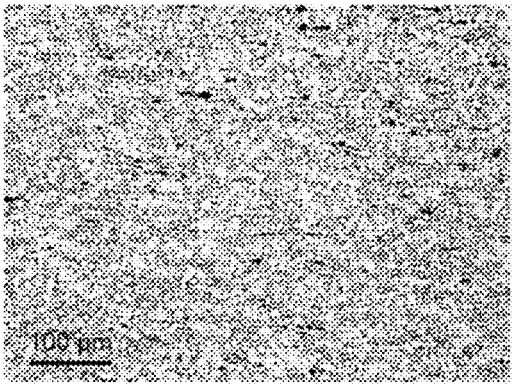
FIG. 43 shows the optical microscope image of the solution treated sample in the Comparative Example 4.
Figure 44:
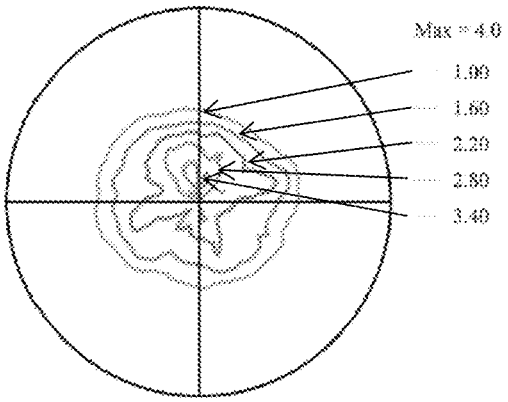
FIG. 44 shows the (0002) pole figure of the solution treated sample in the Comparative Example 4.

FIG. 43 shows the optical microscope image of the solution treated sample. The same optical microscope was used as Example 1 etc. The grain size calculated by the linear interception method was 8.0 μm. The grain size was calculated in accordance with ASTM (E112-13) in the same manner as Example 1 etc. FIG. 44 shows the (0002) pole figure of the solution treated sample obtained by the X-ray diffraction. The basal texture intensity of the (0002) pole was 4.0 mrd.

(Process 5: Aging Treatment)

The aging treatment was carried out on the solution treated sample at 170° C. for 2 hours to obtain the magnesium alloy as the aging treated material.

Figure 45:
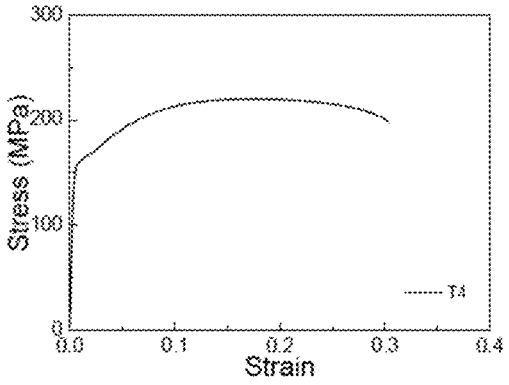
FIG. 45 shows the tensile curve of the solution treated sample in the Comparative Example 4.
Figure 46:
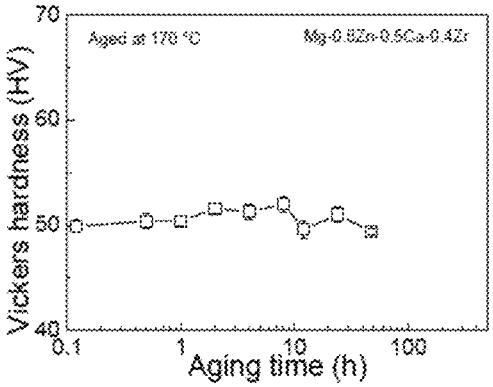
FIG. 46 shows the age hardening curve in the Comparative Example 4.

FIG. 45 shows the tensile curve of the solution treated sample (T4) obtained in process 4. FIG. 46 shows the age hardening curve of the aging treated material (T6) obtained in process 5.

As shown in Table 21, the result of the measurement of mechanical strength of the obtained solution treated sample in the same manner as that of Example 1 etc. shows that the Index Erichsen value is 7.4 mm, the yield strength was 157 MPa, the tensile strength was 220 MPa and the elongation to failure was 30%. The solution treated sample has the excellent room temperature formability.

TABLE 21

| | Yield strength $\delta_{YS}$ (MPa) | Tensile strength $\delta_{UTS}$ (MPa) | Elongation $\varepsilon_{total}$ (%) | Formability Index Erichsen (mm) |
|---|---|---|---|---|
| Solution treated sample (T4) | 157 | 220 | 30 | 7.4 |

The result of the measurement of a variation of the magnesium alloy obtained in Comparative Example 4 showed that the Vickers hardness relative to the aging time was approximately 51.6 HV without being age hardened.

Comparative Example 5

Alloy composition: Mg-1.6Zn-0.5Ca-0.4Zr (Sample B)

Rough rolling process: Sample temperature 100° C., rolling temperature 100° C.

Reheating temperature: At 450° C. for 5 minutes

Solution treatment: At 350° C. for 1 hour

Aging treatment: At 170° C. for 2 hours (Process 1: Casting)

In the same manner as Example 1 etc., the alloy of Mg-1.6Zn-0.5Ca-0.4Zr was melted using the high frequency induction melting furnace and then was cast in the mold to manufacture a cast ingot. The thickness of the cast ingot was approximately 10 mm.

(Process 2: Homogenization Treatment)

As shown in FIG. 1(*b*), the cast ingot was heated at 300° C. for 4 hours, the temperature was raised to 450° C. at a rate of 7.5° C./h, and the temperature was kept at 450° C. for 6 hours for heat treatment. Next, the cast ingot was removed from the heat treatment furnace, air cooled down to 300° C. and water-quenched for homogenization treatment to manufacture the homogenized ingot. In the homogenization treatment, to suppress initial melting of the Mg—Zn phase formed during casting, the cast ingot was heat treated at 300° C. and then was heated treated at 400° C. to 500° C. to homogenize the Zn distribution.

(Process 3: Hot or Warm Working)

In the same manner as Example 1 etc., the material was manufactured by passing the homogenized ingot through the rolling passage capable of applying pressure by the rolling equipment to carry out individually the rough rolling process and the final rolling process.

As shown in FIG. 1(*b*), in the rough rolling process, the homogenized ingot was passed through the rolling passage 4 times at the rolling rate of 15% with the sample and rolling temperatures set to 300° C. using the rolling equipment with circumferential rolling speed of 2 m/min to roll the 10 mm thickness homogenized ingot so as to thin down to 5 mm thickness.

The final rolling process following the rough rolling process was carried out while the intermediate heat treatment was applied, using the rolling equipment with circumferential rolling speed of 2 m/min. As shown in FIG. 1(*b*), in the final rolling process, the homogenized ingot was passed through the rolling passage 6 times at the rolling rate of 23% with the sample and rolling temperatures set to 100° C. The material was manufactured by carrying out the final rolling process to thin down to 1 mm thickness, while the intermediate heat treatment was applied with the sample reheating temperature kept at 450° C. for 5 minutes and the sample was air-cooled every time the homogenized ingot was passed through the rolling passage. The static crystallization was achieved by the intermediate heat treatment to decrease the degree of orientation of grains.

(Process 4: Solution Treatment)

The solution treated sample was manufactured by carrying out the solution treatment on a plate-like material. The solution treatment was carried out by heating the material at 350° C. for 1 hour.

Figure 47:
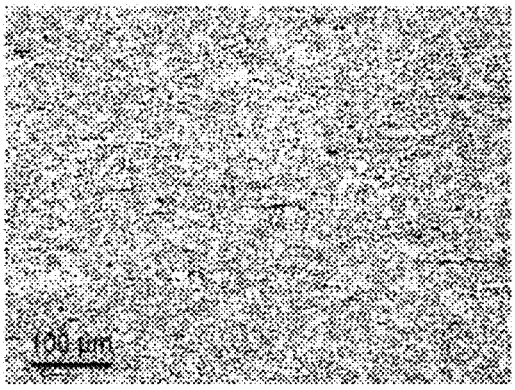
FIG. 47 shows the optical microscope image of the solution treated sample in the Comparative Example 5.
Figure 48:
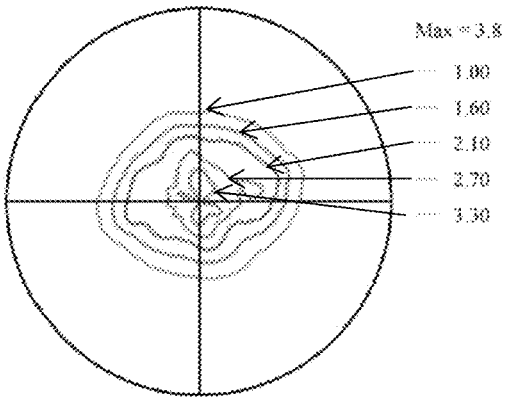
FIG. 48 shows the (0002) pole figure of the solution treated sample in the Comparative Example 5.

FIG. 47 shows the optical microscope image of the solution treated sample. The same optical microscope was used as Example 1 etc. The grain size calculated by the linear interception method was 7.2 μm. The grain size was calculated in accordance with ASTM (E112-13) in the same manner as Example 1 etc. FIG. 48 shows that the (0002) pole figure of the solution treated sample obtained by the X-ray diffraction. The basal texture intensity of the (0002) pole was 3.8 mrd.

(Process 5: Aging Treatment)

The aging treatment was carried out on the solution treated sample at 170° C. for 2 hours to obtain the magnesium alloy as the aging treated material.

Figure 49:
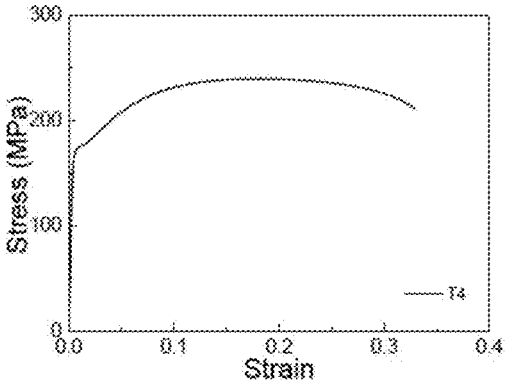
FIG. 49 shows the tensile curve of the solution treated sample in the Comparative Example 5.
Figure 50:
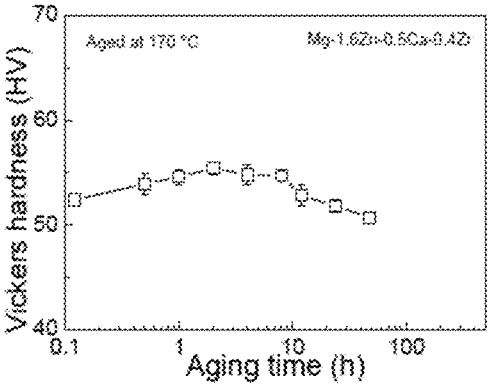
FIG. 50 shows the age hardening curve in the Comparative Example 5.

FIG. 49 shows the tensile curve of the solution treated sample (T4) obtained in process 4. FIG. 50 shows the age hardening curve of the aging treated material (T6) obtained in process 5.

As shown in Table 22, the result of the measurement of mechanical strength of obtained by the solution treated sample in the same manner as that of Example 1 etc. shows that the Index Erichsen value was 7.7 mm, the yield strength was 171 MPa, the tensile strength was 240 MPa and the elongation to failure was 33%. The solution treated sample has the excellent room temperature formability.

TABLE 22

| | Yield strength $\delta_{YS}$ (MPa) | Tensile strength $\delta_{UTS}$ (MPa) | Elongation $\varepsilon_{total}$ (%) | Formability Index Erichsen (mm) |
|---|---|---|---|---|
| Solution treated sample (T4) | 171 | 240 | 33 | 7.7 |

The result of the measurement of a variation of the magnesium alloy obtained in Comparative Example 5 showed that the Vickers hardness relative to the aging time was approximately 55.4 HV without being age hardened.

Table 23 shows the microstructures and properties of the solution treated samples (T4) in Examples and Comparative Examples. Symbols A to F in Table 23 correspond to those in Table 1.

TABLE 23

| | | Solution treatment | | Mechanical characteristics | | | | | Microstructure | |
|---|---|---|---|---|---|---|---|---|---|---|
| | Symbol | Temperature ° C. | Time h | I.E. (mm) | Hardness HV | $\delta_{YS}$ MPa | $\delta_{UTS}$ MPa | $\varepsilon_{total}$ % | Grain size μm | Basal texture intensity at the (0002) pole m.r.d. |
| Example 1 | A | 400 | 1 | 7.7 | 48.8 | 146 | 220 | 30 | 9.0 | 3.2 |
| Example 2 | B | 400 | 1 | 8.2 | 53.5 | 163 | 245 | 34 | 8.5 | 3.4 |
| Example 3 | C | 400 | 1 | 8.1 | 51.8 | 102 | 245 | 32 | 7.5 | 3.1 |
| Example 4 | A | 450 | 1 | 7.7 | 47.1 | 136 | 227 | 31 | 13.7 | 3.7 |

TABLE 23-continued

| | | Solution treatment | | Mechanical characteristics | | | | | Microstructure | |
|---|---|---|---|---|---|---|---|---|---|---|
| | Symbol | Temperature ° C. | Time h | I.E. (mm) | Hardness HV | $\delta_{YS}$ MPa | $\delta_{UTS}$ MPa | $\varepsilon_{total}$ % | Grain size μm | Basal texture intensity at the (0002) pole m.r.d. |
| Example 5 | A | 500 | 1 | 7.5 | 50.7 | 129 | 230 | 28 | 16.0 | 3.9 |
| Example 6 | B | 430 | 1 | 8.0 | 54.2 | 163 | 245 | 31 | 8.2 | 3.4 |
| Example 7 | C | 430 | 1 | 8.1 | 51.3 | 161 | 241 | 35 | 9.0 | 3.2 |
| Comparative Example 1 | D | 400 | 1 | 6.5 | 49.3 | 148 | 224 | 28 | 10.0 | 3.1 |
| Comparative Example 2 | E | 400 | 1 | 7.0 | 43.2 | 118 | 206 | 28 | 20.3 | 4.2 |
| Comparative Example 3 | F | 400 | 1 | 6.6 | 45.0 | 164 | 226 | 36 | 11.5 | 4.0 |
| Comparative Example 4 | A | 350 | 1 | 7.4 | 50.7 | 157 | 220 | 30 | 8.0 | 4.0 |
| Comparative Example 5 | B | 350 | 1 | 7.7 | 52.4 | 111 | 240 | 33 | 7.2 | 3.8 |

Table 24 shows the microstructures and properties of the aging treated materials (T6) in Examples and Comparative Examples. Just like Table 23, symbols A to F in Table 24 correspond to those in Table 1.

TABLE 24

| | | Solution treatment | | Aging treatment | | Mechanical characteristics | | | |
|---|---|---|---|---|---|---|---|---|---|
| | Symbol | Temp ° C. | Time h | Aging Temp ° C. | Aging Time h | Hardness HV | $\delta_{YS}$ MPa | $\delta_{UTS}$ MPa | $\varepsilon_{total}$ % |
| Example 1 | A | 400 | 1 | 170 | 4 | 59.3 | 187 | 247 | 25 |
| Example 2 | B | 400 | 1 | 170 | 2 | 62.9 | 204 | 258 | 31 |
| Example 3 | C | 400 | 1 | 170 | 4 | 59.7 | 195 | 263 | 30 |
| Example 4 | A | 450 | 1 | 170 | 4 | 62.8 | 198 | 261 | 27 |
| Example 5 | A | 500 | 1 | 170 | 4 | 65.7 | 218 | 273 | 28 |
| Example 6 | B | 430 | 1 | 170 | 4 | 66.8 | 215 | 272 | 30 |
| Example 7 | C | 430 | 1 | 170 | 4 | 61.2 | 200 | 257 | 28 |
| Comparative Example 1 | D | 400 | 1 | 170 | 4 | 57.4 | 187 | 224 | 28 |
| Comparative Example 2 | E | 400 | 1 | 170 | 4 | 54.7 | 155 | 229 | 25 |
| Comparative Example 3 | F | 400 | 1 | 170 | 0.5 | 46.5 | | | |
| Comparative Example 4 | A | 350 | 1 | 170 | 2 | 51.6 | | | |
| Comparative Example 5 | B | 350 | 1 | 170 | 2 | 55.4 | | | |

The magnesium alloys in Examples 1 to 7 show that the Index Erichsen value was 7.0 mm or higher and preferably 7.5 mm or higher. Their degrees of orientation of grains at the bottoms of the magnesium matrixes are low. The values for basal texture intensity at the (0002) pole obtained by the X-ray diffraction are at least less than 4.0 mrd. The average grain sizes are 5 μm to 20 μm. Thus, the magnesium alloys in Examples 1 to 7 have the excellent room temperature formability.

As shown in the aforementioned Examples 1 to 7 and Comparative Examples 1 to 5, it is preferable that the following requirements are satisfied to achieve the excellent room temperature formability in magnesium alloys.

(1) The degree of orientation of grains at the (0002) pole measured by the X-ray diffraction is to be 4.0 mrd or lower in basal texture intensity.

(2) The amount of Zn added is to be at least 0.8 wt % or more. This is to form the highly density of G. P. Zone by the aging treatment.

(3) The amount of Ca added is to be at least 0.3 wt % or more. Ca is added to reduce the basal texture intensity at the (0002) pole and to form the highly density of G. P. Zone by the aging treatment.

(4) The amount of Zr added is to be at least 0.2 wt % or more.

The magnesium alloys in Examples 1 to 7 have 180 MPa or higher in yield strength and desirably 200 MPa or higher with fine grains. The alloy elements were dissolved on the surfaces of magnesium matrixes with precipitates dispersed. Thus, the magnesium alloys in Examples 1 to 7 have the excellent room temperature formability.

It is preferable that to significantly enhance the strength, the alloy elements with significantly different in atomic radius from those of the matrixes are to be dissolved at a high density. To significantly enhance the strength, preferably, the grain size is finer and the number density is higher.

As shown in the aforementioned Examples 1 to 7 and Comparative Examples 1 to 5, it is preferable that the following requirements are satisfied to achieve excellent strength in magnesium alloys.

(1) The solution treatment is to be carried out at 400° C. or higher to 500° C. or lower, which allows the alloy elements to be dissolved on the surface of the matrix into the supersaturated state and the supersaturated precipitates are finely dispersed by the aging treatment, thereby resulting in the enhanced strength.

(2) The magnesium alloy has 120 MPa or higher of yield strength after the solution treatment.

(3) The age hardening allows fine precipitates to be formed to enhance the strength. The effect of age hardening is at least 8 HV or higher.

(4) The amount of Zr added is to be 2.0 wt % or lower.

(5) The upper limit of the amount of Zn added is preferably 1.0 wt %. An increase in amount of Zn added showed a trend toward the reduced effect of age hardening; thereby, to achieve 7 HV or higher of increase in hardness, which is needed, it is preferable that the amount of Zn added is 1.0 wt % or lower.

(6) At least 0.3 wt % Ca is to be contained. Ca, one of the constituent elements of the precipitates, essentially has to be added.

(7) At least 0.2 wt % Zr is to be contained. Zr is to be 1.0 wt % or lower.

(8) The grain size is preferably 20 μm or lower.

As aforementioned, the present invention relates to the magnesium alloy sheet material and the press-molded body with the excellent room temperature formability. The sheet material has the following properties. Specifically, it is characterized that the sheet material shows that the Index Erichsen value was 7.0 mm or higher and its yield strength at room temperature may be enhanced by 180 MPa or higher by the aging treatment following the solution treatment. It comprises 0.5 wt % to 2.0 wt % of Zn, 0.3 wt % to 0.8 wt % of Ca and at least 0.2 wt % of Zr, with the remainder comprising Mg and unavoidable impurities. After the solution treatment, it shows 20 μm or lower in average grain size. The normalized basal texture intensity in the central part of plate thickness on a RD-TD face measured by the X-ray diffraction in the (0002) pole figure is 4.0 mrd or lower. It has a structure with nano-precipitates of Mg, Ca and Zn dispersed in the magnesium matrix. The method for manufacturing the sample may be any of swaging processing techniques, which allow the aforementioned microstructure to be manufactured, such as forging and extrusion processing including rolling and twin toll casting rolling.

The present invention is not limited to the aforementioned embodiments and various types of variations within the scope of the present invention may be accepted; it goes without saying that these variations are included within the scope of the present invention.

What is claimed is:

1. A magnesium alloy, consisting of:
0.5-1.6 wt % of Zn;
0.3-0.5 wt % of Ca;
at least 0.2 wt % of Zr; and
the remainder consisting of Mg and unavoidable impurities
wherein
a Guinier-Preston Zone precipitate comprising Mg, Ca and Zn is dispersed on the (0001) plane of a magnesium matrix and has a plate-like shape, and
an Index Erichsen value at room temperature is 7.0 mm or higher.

2. The magnesium alloy as set forth in claim 1, wherein the average grain size of the magnesium matrix is 5 μm to 20 μm.

3. The magnesium alloy as set forth in claim 1, wherein the normalized basal texture intensity of the (0002) pole on a normalized in the central part of plate thickness on a RD-TD face measured by the X-ray diffraction is less than 4.0 mrd.

4. The magnesium alloy as set forth in claim 1, wherein the 0.2% proof strength of a solution treated sample is 120 MPa or higher.

5. The magnesium alloy as set forth in claim 1, wherein the 0.2% proof strength of an aging treated material is 180 MPa or higher.

6. The magnesium alloy as set forth in claim 1, wherein the number density of the Guinier-Preston Zone is $4.5\times10^{22}$ $m^{-3}$ to $5\times10^{23}$ $m^{-3}$.

7. A method for manufacturing the magnesium alloy as set forth in claim 1,
the method comprises the steps of:
process 1 of melting Mg, Zn, Ca and Zr to obtain a cast ingot;
process 2 of carrying out a homogenization treatment on the cast ingot to obtain a homogenized ingot;
process 3 of carrying out hot working or warm working on the homogenized ingot to obtain a material;
process 4 of carrying out a solution treatment on the material to obtain a solution treated sample; and
process 5 of carrying out an aging treatment on the solution treated sample to obtain the magnesium alloy.

8. The method for manufacturing the magnesium alloy as set forth in claim 7, wherein the homogenized ingot is reheated at 450° C. in process 3.

9. The method for manufacturing the magnesium alloy as set forth in claim 7, wherein the homogenization treatment is carried out at a temperature between 400° C. to 500° C. for a given time period in process 2 and the aging treatment is carried out at a temperature between 140° C. to 250° C. for a given time period in process 5.

10. The method for manufacturing the magnesium alloy as set forth in claim 7, wherein the aging treatment is carried out in process 5 until the hardness of the magnesium alloy increases.

* * * * *